US012460373B2

(12) United States Patent
Morita

(10) Patent No.: US 12,460,373 B2
(45) Date of Patent: Nov. 4, 2025

(54) SHOVEL

(71) Applicant: SUMITOMO HEAVY INDUSTRIES, LTD., Tokyo (JP)

(72) Inventor: Junichi Morita, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1036 days.

(21) Appl. No.: 17/023,552

(22) Filed: Sep. 17, 2020

(65) Prior Publication Data

US 2021/0002851 A1 Jan. 7, 2021

Related U.S. Application Data

(63) Continuation of application No. PCT/JP2019/011244, filed on Mar. 18, 2019.

(30) Foreign Application Priority Data

Mar. 20, 2018 (JP) ..... 2018-053219

(51) Int. Cl.
*E02F 3/43* (2006.01)
*E02F 9/20* (2006.01)

(52) U.S. Cl.
CPC ..... *E02F 3/434* (2013.01); *E02F 9/2004* (2013.01)

(58) Field of Classification Search
CPC ..... E02F 3/434; E02F 9/2004; E02F 3/438; E02F 3/439; E02F 9/123; E02F 9/203; E02F 9/2235; E02F 9/2242; E02F 9/2282; E02F 9/2285; E02F 9/262; E02F 9/265; E02F 9/2228; E02F 3/435; G05D 2201/0202
See application file for complete search history.

(56) References Cited

U.S. PATENT DOCUMENTS 5,493,798 A 2/1996 Rocke et al.
5,857,828 A 1/1999 Lee et al.
5,908,458 A 6/1999 Rowe et al.
(Continued)

FOREIGN PATENT DOCUMENTS

CN 106013311 A * 10/2016 ..... E02F 3/43
CN 107740448 A * 2/2018
(Continued)

OTHER PUBLICATIONS

International Search Report for PCT/JP2019/011244 mailed on Jun. 18, 2019.

*Primary Examiner* — Anne Marie Antonucci
*Assistant Examiner* — Jewel Ashley Kuntz
(74) *Attorney, Agent, or Firm* — IPUSA, PLLC

(57) ABSTRACT

A shovel (100) according to embodiments of the present invention includes a lower travelling body (1), an upper pivot body (3) pivotably mounted to the lower travelling body (1), an excavation attachment (AT) rotatably mounted to the upper pivot body, and a controller (30) provided to the upper pivot body (3). The controller (30) is configured to autonomously perform a compound operation including an operation of the excavation attachment (AT) and a pivot operation. The controller (30) may be configured to, in response to an automatic switch (NS2) provided in a cabin (10) mounted to the upper pivot body (3) being operated, autonomously perform the compound operation.

17 Claims, 21 Drawing Sheets

(56) References Cited

U.S. PATENT DOCUMENTS

| | | | | |
|---|---|---|---|---|
| 9,909,283 | B2 | 3/2018 | Li | |
| 10,358,795 | B2 | 7/2019 | Hoshaku et al. | |
| 2006/0090379 | A1* | 5/2006 | Furem | E02F 9/262 37/443 |
| 2009/0099738 | A1* | 4/2009 | Danko | E02F 9/2041 701/50 |
| 2009/0218112 | A1* | 9/2009 | Mintah | E02F 3/437 701/50 |
| 2012/0290178 | A1* | 11/2012 | Suzuki | E02F 9/265 701/50 |
| 2015/0299989 | A1* | 10/2015 | Nagato | E02F 9/267 701/34.4 |
| 2018/0135277 | A1* | 5/2018 | Tsuji | E02F 9/26 |
| 2018/0305902 | A1 | 10/2018 | Tsukamoto | |
| 2019/0226181 | A1* | 7/2019 | Imura | E02F 9/2221 |

FOREIGN PATENT DOCUMENTS

| | | | |
|---|---|---|---|
| JP | S58162816 | A * | 9/1983 |
| JP | H10-217170 | | 8/1998 |
| JP | H11-181837 | | 7/1999 |
| JP | H11-293711 | | 10/1999 |
| JP | 2000-291076 | | 10/2000 |
| JP | 2011-514456 | | 5/2011 |
| JP | 2012-021290 | | 2/2012 |
| JP | 2017-044027 | | 3/2017 |
| JP | 2017-227012 | | 12/2017 |
| WO | 2009/111363 | | 9/2009 |
| WO | 2011/090077 | | 7/2011 |
| WO | 2013/099491 | | 7/2013 |
| WO | 2017/115809 | | 7/2017 |

* cited by examiner

SHOVEL

CROSS-REFERENCE TO RELATED APPLICATIONS

The present application is a continuation application of International Application No. PCT/JP2019/011244 filed on Mar. 18, 2019, which claims priority to Japanese Patent Application No. 2018-053219 filed on Mar. 20, 2018. The contents of these applications are incorporated herein by reference in their entirety.

BACKGROUND

Technical Field

The present disclosure relates to shovels.

Description of the Related Art

Conventionally, a hydraulic excavator equipped with a semi-autonomous excavation control system is known (see Patent Document 1). The excavation control system is configured to, if a predetermined condition is satisfied, autonomously perform a boom up pivot operation.

SUMMARY

However, the above-stated excavation control system is configured to autonomously perform the boom up pivot operation without notifying the operator if a predetermined amount of the boom up operation and a predetermined amount of the pivot operation are simultaneously performed by the operator, that is, regardless of the operator's intention. Therefore, there is a risk that the boom up pivot operation may be performed against the operator's intention.

Accordingly, it is desirable to provide a shovel that can autonomously perform a compound operation including the pivot operation in accordance with the operator's intention.

A shovel according to an embodiment of the present invention includes a lower travelling body, an upper pivot body pivotably mounted to the lower travelling body, an attachment attached to the upper pivot body, and a controller provided to the upper pivot body, and the controller is configured to autonomously perform a compound operation including an operation of the attachment and a pivot operation.

According to the above-stated solution, a shovel that can autonomously perform a compound operation including a pivot operation in accordance with the operator's intention is provided.

DETAILED DESCRIPTION

Figure 1A:
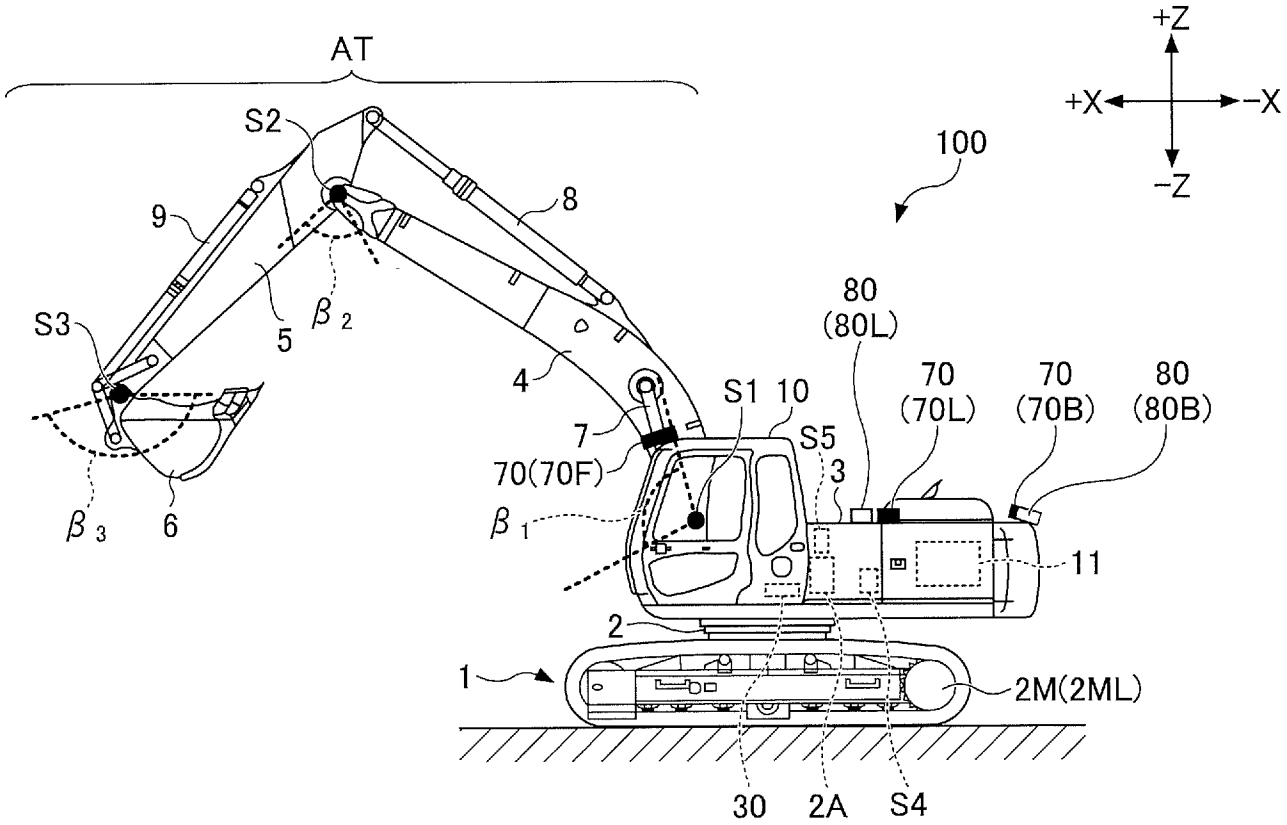
FIG. 1A is a side view of a shovel according to an embodiment of the present invention.
Figure 1B:
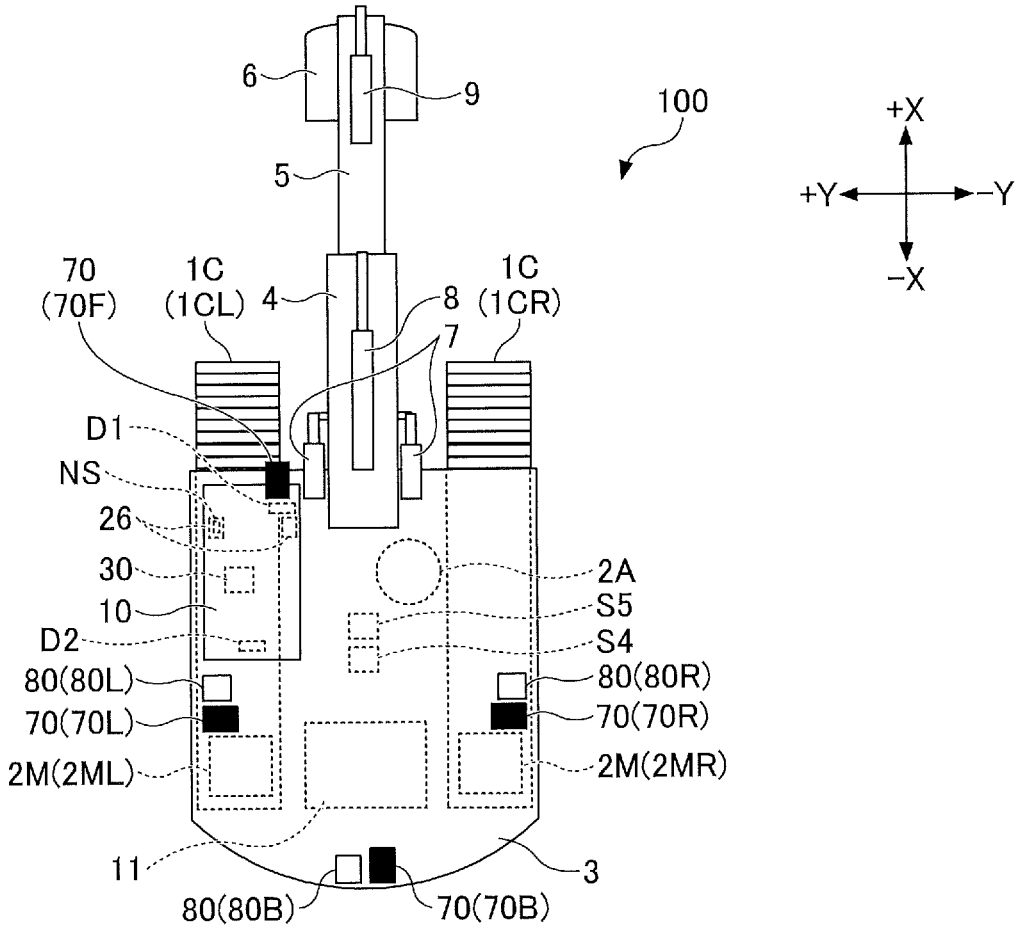
FIG. 1B is a top view of a shovel according to an embodiment of the present invention.

First, a shovel 100 as an excavator according to an embodiment of the present invention is described with reference to FIGS. 1A and 1B. FIG. 1A is a side view of the shovel 100, and FIG. 1B is a top view of the shovel 100.

In this embodiment, a lower travelling object 1 of the shovel 100 includes a crawler 1C. The crawler 1C is driven by a driving hydraulic motor 2M equipped in the lower travelling object 1. Specifically, the crawler 1C includes a left crawler 1CL and a right crawler 1CR. The left crawler 1CL is driven by a left travelling hydraulic motor 2ML, and the right crawler 1CR is driven by a right travelling hydraulic motor 2MR.

An upper pivot body 3 is pivotably mounted to the lower travelling body 1 via a pivot mechanism 2. The pivot mechanism 2 is driven by a pivot hydraulic motor 2A equipped in the upper pivot body 3. However, the pivot hydraulic motor 2A may be a pivot electric generator as an electric actuator.

A boom 4 is mounted to the upper pivot body 3. An arm 5 is attached to a tip of the boom 4, and a bucket 6 is attached to the tip of the arm 5 as an end attachment. The boom 4, the arm 5, and the bucket 6 compose an excavation attachment AT, which is one example of an attachment. The boom 4 is driven by a boom cylinder 7, the arm 5 is driven by an arm cylinder 8, and the bucket 6 is driven by a bucket cylinder 9.

The boom 4 is rotatably supported up and down with respect to the upper pivot body 3. A boom angle sensor S1 is mounted to the boom 4. The boom angle sensor S1 can detect the boom angle $\beta_1$, which is the rotation angle of the boom 4. The boom angle $\beta_1$ may be the rising angle from the state where the boom 4 is most lowered. Therefore, the boom angle $\beta_1$ is maximized when the boom 4 is most raised.

The arm 5 is supported pivotally relative to the boom 4. Then, an arm angle sensor S2 is mounted to the arm 5. The arm angle sensor S2 can detect the arm angle $\beta_2$, which is the rotation angle of the arm 5. The arm angle $\beta_2$ may be the opening angle from the most closed position of the arm 5. Therefore, the arm angle $\beta_2$ is maximized when the arm 5 is most opened.

The bucket 6 is supported rotatably relative to the arm 5. A bucket angle sensor S3 is mounted to the bucket 6. The bucket angle sensor S3 can detect the bucket angle $\beta_3$, which is the rotation angle of the bucket 6. The bucket angle $\beta_3$ is the opening angle from the most closed position of the bucket 6. Therefore, the bucket angle $\beta_3$ is maximized when the bucket 6 is opened most.

In the embodiments shown in FIGS. 1A and 1B, each of the boom angle sensor S1, the arm angle sensor S2, and the bucket angle sensor S3 includes a combination of an acceleration sensor and a gyro sensor. However, it may include only the acceleration sensor. Also, the boom angle sensor S1 may be a stroke sensor, a rotary encoder, a potentiometer, an inertia measuring device, or the like mounted on the boom cylinder 7. The same applies to the arm angle sensor S2 and the bucket angle sensor S3.

A cabin 10 is provided in the upper pivot body 3 as an operator's cab, and a power source such as an engine 11 is installed therein. Further, an object detection device 70, a capturing device 80, a body tilt sensor S4, and a pivot angular velocity sensor S5 are equipped in the upper pivot body 3. An operation device 26, a controller 30, a display device D1, a sound output device D2, and the like are provided inside the cabin 10. For convenience, it is assumed in the upper pivot body 3 that the side where the excavation attachment AT is mounted is the front side and the side where the counterweight is mounted is the rear side.

The object detection device 70 is configured to detect an object that exists around the shovel 100. The object may be, for example, a person, an animal, a vehicle, a construction machine, a building, a wall, a fence, or a hole, or the like. The object detection device 70 may be, for example, an ultrasonic sensor, a millimeter wave radar, a stereo camera, a LIDAR, a distance image sensor, or an infrared sensor, or the like. In this embodiment, the object detection device 70 includes a front sensor 70F mounted to the front end of the top surface of the cabin 10, a rear sensor 70B mounted to the rear end of the top surface of the upper pivot body 3, a left sensor 70L mounted to the left end of the top surface of the upper pivot body 3, and a right sensor 70R mounted to the right end of the top surface of the upper pivot body 3.

The object detection device 70 may be configured to detect a predetermined object within a predetermined area that is set around the shovel 100. Namely, the object detection device 70 may be configured to identify the type of object. For example, the object detection device 70 may be configured to distinguish between a person and an object other than the person.

A capturing device 80 is configured to capture a periphery of the shovel 100. In this embodiment, the capturing device 80 includes a rear camera 80B mounted to the rear end of the top surface of the upper pivot body 3, a left camera 80L mounted to the left end of the top surface of the upper pivot body 3, and a right camera 80R mounted to the right end of the top surface of the upper pivot body 3. The capturing device 80 may include a front camera.

The rear camera 80B is positioned to be adjacent to the rear sensor 70B, the left camera 80L is positioned to be adjacent to the left sensor 70L, and the right camera 80R is positioned to be adjacent the right sensor 70R. If the capturing device 80 includes a front camera, the front camera may be positioned to be adjacent to the front sensor 70F.

An image captured by the capturing device 80 is displayed on the display device D1. The capturing device 80 may be configured so that a viewpoint converted image, such as a bird's-eye image, can be displayed on the display device D1. For example, the bird's-eye image may be generated by combining respective images that are output by the rear camera 80B, the left camera 80L, and the right camera 80R.

The capturing device 80 may be utilized as the object detection device 70. In this case, the object detection device 70 may be omitted.

The body tilt sensor S4 is configured to detect the tilt of the upper pivot body 3 relative to a predetermined plane. In this embodiment, the body tilt sensor S4 is an acceleration sensor that detects an inclination angle about the front and rear axes and an inclination angle about the right and left axes of the upper pivot body 3 with respect to the horizontal plane. For example, the front and rear axes and the left and right axes of the upper pivot body 3 may pass through a shovel center point, which is one point on the pivot axis of the shovel 100 perpendicular to each other.

The pivot angular velocity sensor S5 is configured to detect the pivot angular velocity of the upper pivot body 3. In this embodiment, the pivot angular velocity sensor S5 is a gyro sensor. The pivot angular velocity sensor S5 may be a resolver, a rotary encoder, or the like. The pivot angular velocity sensor S5 may detect the pivot velocity. The pivot velocity may be calculated from the pivot angular velocity.

Hereinafter, each of the boom angle sensor S1, the arm angle sensor S2, the bucket angle sensor S3, the body tilt sensor S4, and the pivot angle sensor S5 may be also referred to as a posture detection device.

The display device D1 is a device for displaying information. The sound output device D2 is a device for outputting sound. The operation device 26 is a device used by an operator to operate an actuator.

The controller 30 is a controller for controlling the shovel 100. In this embodiment, the controller 30 is arranged with a computer including a CPU, a RAM, a NVRAM, a ROM and others. The controller 30 reads programs corresponding to respective functions from the ROM and loads the programs into the RAM to cause the CPU to perform operations corresponding to the respective functions. The functions may include, for example, a machine guidance function to guide manual operations by an operator for the shovel 100 and a machine control function to automatically assist the manual operations by the operator for the shovel 100.

Figure 2:
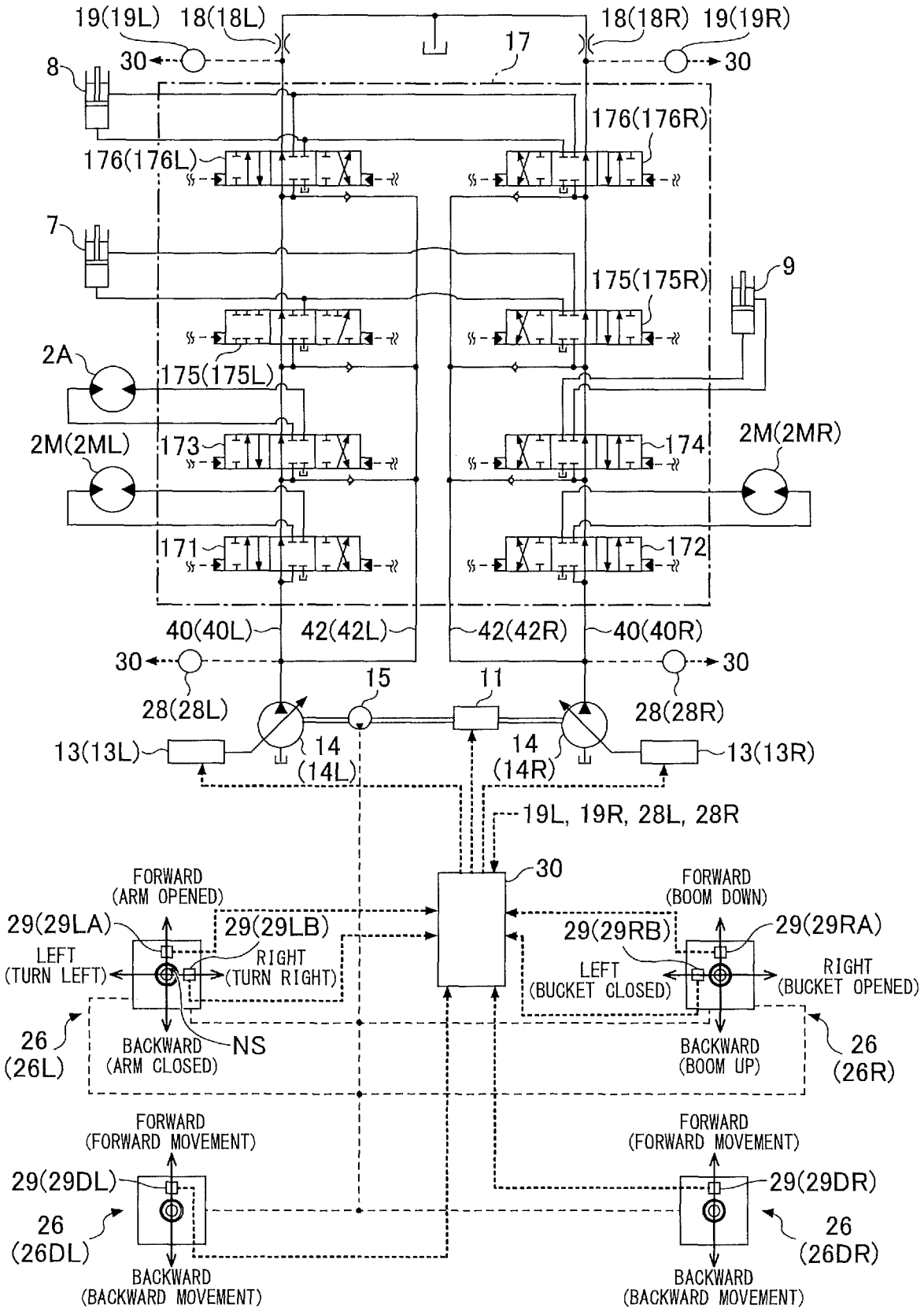
FIG. 2 is a diagram for illustrating an exemplary arrangement of a hydraulic system equipped to a shovel.

Next, an exemplary arrangement of a hydraulic system equipped to the shovel 100 is described with reference to FIG. 2. FIG. 2 is a diagram for illustrating an exemplary arrangement of the hydraulic system equipped to the shovel 100. In FIG. 2, a mechanical power transmission system, a hydraulic oil line, a pilot line, and an electrical control system are illustrated as a double line, a solid line, a dashed line and a dotted line, respectively.

The hydraulic system of the shovel 100 mainly includes an engine 11, a regulator 13, a main pump 14, a pilot pump 15, a control valve 17, an operation device 26, an discharge pressure sensor 28, an operation pressure sensor 29, and a controller 30, and the like.

In FIG. 2, the hydraulic system circulates the hydraulic oil from the main pump 14, which is driven by the engine 11, to a hydraulic oil tank via a center bypass line 40 or a parallel line 42.

The engine 11 is a driving source of the shovel 100. In this embodiment, the engine 11 may be a diesel engine that operates to retain a predetermined number of rotations, for example. An output shaft of the engine 11 is coupled to respective input shafts of the main pump 14 and the pilot pump 15.

The main pump 14 is configured to supply the hydraulic oil to the control valve 17 via a hydraulic oil line. In this embodiment, the main pump 14 is a swashplate type variable displacement hydraulic pump.

The regulator 13 is configured to control the discharge volume (push back volume) of the main pump 14. In this embodiment, the regulator 13 controls the discharge volume (push back volume) of the main pump 14 by adjusting the swashplate tilt angle of the main pump 14 in response to a control command from the controller 30.

The pilot pump 15 is configured to supply the hydraulic oil to a hydraulic control device including the operation device 26 via a pilot line. In this embodiment, the pilot pump 15 is a fixed displacement hydraulic pump. However, the pilot pump 15 may be omitted. In this case, the function performed by the pilot pump 15 may be implemented by the main pump 14. Namely, in addition to the function of supplying the hydraulic oil to the operation device 26, the main pump 14 may include a function of supplying the hydraulic oil to the operation device 26 or the like after the pressure of the hydraulic oil is lowered by a squeeze or the like.

The control valve 17 is configured to control the flow of the hydraulic oil in the hydraulic system. In this embodiment, the control valve 17 includes control valves 171 to 176. The control valve 175 includes a control valve 175L and a control valve 175R, and the control valve 176 includes a control valve 176L and a control valve 176R. The control valve 17 can selectively supply the hydraulic oil discharged by the main pump 14 to one or more hydraulic actuators through the control valves 171 to 176. The control valves 171 to 176 control the flow of the hydraulic oil from the main pump 14 to the hydraulic actuator and the flow of the hydraulic oil from the hydraulic actuator to the hydraulic oil tank. The hydraulic actuator includes a boom cylinder 7, an arm cylinder 8, a bucket cylinder 9, a left travelling hydraulic motor 2ML, a right travelling hydraulic motor 2MR, and a pivot hydraulic motor 2A.

The operation device 26 is a device used by an operator to operate an actuator. The actuator includes at least one of a hydraulic actuator and an electric actuator. In this embodiment, the operation device 26 supplies the hydraulic oil discharged by the pilot pump 15 to a pilot port of the corresponding control valve in the control valve 17 via a pilot line. The pressure (pilot pressure) of the hydraulic oil supplied to each of the pilot ports is the pressure corresponding to the operation direction and the operation amount of levers or pedals (not shown) of the operation device 26 corresponding to each of the hydraulic actuators. However, the operation device 26 may be electrically controlled rather than the pilot pressure type as described above. In this case, the control valve in the control valve 17 may be an electromagnetic solenoid spool valve.

The discharge pressure sensor 28 is configured to detect the discharge pressure of the main pump 14. In this embodiment, the discharge pressure sensor 28 outputs the detected value to the controller 30.

The operation pressure sensor 29 is configured to detect operational contents of the operation device 26 by an operator. In this embodiment, the operation pressure sensor 29 detects the operation direction and the operation amount of levers or pedals of the operation device 26 corresponding to respective actuators in the form of pressure (operation pressure) and outputs the detected value as operation data to the controller 30. The operational contents of the operation device 26 may be detected using sensors other than the operation pressure sensor.

The main pump 14 includes a left main pump 14L and a right main pump 14R. The left main pump 14L is configured to circulate the hydraulic oil to the hydraulic oil tank through the left center bypass line 40L or the left parallel line 42L. The right main pump 14R is configured to circulate the hydraulic oil to the hydraulic oil tank through the right center bypass line 40R or the right parallel line 42R.

The left center bypass line 40L is a hydraulic oil line through the control valves 171, 173, 175L, and 176L disposed in the control valve 17. The right center bypass line 40R is a hydraulic oil line through the control valves 172, 174, 175R, and 176R disposed in the control valve 17.

The control valve 171 is a spool valve that supplies the hydraulic oil discharged by the left main pump 14L to the left travelling hydraulic motor 2ML and switches the flow of the hydraulic oil to discharge the hydraulic oil discharged by the left travelling hydraulic motor 2ML to the hydraulic oil tank.

The control valve 172 is a spool valve that supplies the hydraulic oil discharged by the right main pump 14R to the right travelling hydraulic motor 2MR and switches the flow of the hydraulic oil to discharge the hydraulic oil discharged by the right travelling hydraulic motor 2MR to the hydraulic oil tank.

The control valve 173 is a spool valve which supplies the hydraulic oil discharged by the left main pump 14L to the pivot hydraulic motor 2A and switches the flow of the hydraulic oil to discharge the hydraulic oil to the hydraulic oil tank.

The control valve 174 is a spool valve which supplies the hydraulic oil discharged by the right main pump 14R to the bucket cylinder 9 and switches the flow of the hydraulic oil to discharge the hydraulic oil in the bucket cylinder 9 to the hydraulic oil tank.

The control valve 175L is a spool valve that switches the flow of the hydraulic oil to supply the hydraulic oil discharged by the left main pump 14L to the boom cylinder 7. The control valve 175R is a spool valve that supplies the hydraulic oil discharged by the right main pump 14R to the boom cylinder 7 and switches the flow of the hydraulic oil to discharge the hydraulic oil in the boom cylinder 7 to the hydraulic oil tank.

The control valve 176L is a spool valve that supplies the hydraulic oil discharged by the left main pump 14L to the arm cylinder 8 and switches the flow of the hydraulic oil to discharge the hydraulic oil in the arm cylinder 8 to the hydraulic oil tank.

The control valve 176R is a spool valve that supplies the hydraulic oil discharged by the right main pump 14R to the arm cylinder 8 and switches the flow of the hydraulic oil to discharge the hydraulic oil in the arm cylinder 8 to the hydraulic oil tank.

The left parallel line 42L is a hydraulic oil line parallel to the left center bypass line 40L. When the flow of the hydraulic oil passing through the left center bypass line 40L is restricted or interrupted by any of the control valves 171, 173, or 175L, the left parallel line 42L can supply the hydraulic oil to downstream control valves. When the flow of the hydraulic oil passing through the right center bypass line 40R is restricted or interrupted by any of the control valves 172, 174, or 175R, the right parallel line 42R is a hydraulic oil line parallel to the right center bypass line 40R. The right parallel line 42R can supply the hydraulic oil to downstream control valves.

The regulator 13 includes a left regulator 13L and a right regulator 13R. The left regulator 13L controls the discharge amount of the left main pump 14L by adjusting the swashplate tilt angle of the left main pump 14L corresponding to the discharge pressure of the left main pump 14L. Specifically, the left regulator 13L adjusts the swashplate tilt angle of the left main pump 14L corresponding to an increase in the discharge pressure of the left main pump 14L to reduce the discharge amount, for example. The same applies to the right regulator 13R. This is because the absorbing horsepower of the main pump 14, which is represented as the product of the discharge pressure and the discharge amount, is not caused to exceed the output horsepower of the engine 11.

The operation device 26 includes a left operation lever 26L, a right operation lever 26R and a drive lever 26D. The drive lever 26D includes a left drive lever 26DL and a right drive lever 26DR.

The left operation lever 26L is used for the pivot operations and the operation of the arm 5. The left operation lever 26L, when it is operated in the forward-backward direction, utilizes the hydraulic oil discharged by the pilot pump 15 to apply the control pressure corresponding to the lever operation amount to a pilot port of the control valve 176. Also, the left operation lever 26L, when it is operated in the right-left direction, utilizes the hydraulic oil discharged by the pilot pump 15 to apply the control pressure corresponding to the lever operation amount to a pilot port of the control valve 173.

Specifically, the left operation lever 26L, when it is operated in the arm closing direction, introduces the hydraulic oil to a right pilot port of the control valve 176L and introduces the hydraulic oil to a left pilot port of the control valve 176R. Also, the left operation lever 26L, when it is operated in the arm opening direction, introduces the hydraulic oil to a left pilot port of the control valve 176L and introduces the hydraulic oil to a right pilot port of the control valve 176R. Also, the left operation lever 26L, when it is operated in the left pivot direction, introduces the hydraulic oil to a left pilot port of the control valve 173 and, when it is operated in the right pivot direction, introduces the hydraulic oil to a right pilot port of the control valve 173.

The right operation lever 26R is used to operate the boom 4 and the bucket 6. The right operation lever 26R, when it is operated in a forward-backward direction, utilizes the hydraulic oil discharged by the pilot pump 15 to apply the control pressure corresponding to the lever operation amount to a pilot port of the control valve 175. Also, the right operation lever 26R, when it is operated in the left-right direction, utilizers the hydraulic oil discharged by the pilot pump 15 to apply the control pressure corresponding to the lever operation amount to a pilot port of the control valve 174.

Specifically, the right operation lever 26R, when it is operated in the boom down direction, introduces the hydraulic oil to a right pilot port of the control valve 175R. Also, the right operation lever 26R, when it is operated in the boom up direction, introduces the hydraulic oil to a right pilot port of the control valve 175L and introduces the hydraulic oil to a left pilot port of the control valve 175R. Also, the right operation lever 26R, when it is operated in the bucket closing direction, introduces the hydraulic oil to a left pilot port of the control valve 174 and, when it is operated in the bucket opening direction, introduces the hydraulic oil to a right pilot port of the control valve 174.

The drive lever 26D is used to operate the crawler 10. Specifically, the left drive lever 26DL is used to operate the left crawler 1CL. The left drive lever 26DL may be configured to interlock with a left drive pedal. The left drive lever 26DL, when it is operated in the forward-backward direction, utilizes the hydraulic oil discharged by the pilot pump 15 to apply the control pressure corresponding to the lever operation amount to a pilot port of the control valve 171. The right drive lever 26DR is used to operate the right crawler 1CR. The right drive lever 26DR may be configured to interlock with a right drive pedal. The right drive lever 26DR, when it is operated in the forward-backward direction, utilizes the hydraulic oil discharged by the pilot pump 15 to apply the control pressure corresponding to the lever operation amount to a pilot port of the control valve 172.

The discharge pressure sensor 28 includes a discharge pressure sensor 28L and a discharge pressure sensor 28R. The discharge pressure sensor 28L detects the discharge pressure of the left main pump 14L and outputs a detected value to the controller 30. The same applies to the discharge pressure sensor 28R.

The operation pressure sensor 29 includes operation pressure sensors 29LA, 29LB, 29RA, 29RB, 29DL, and 29DR. The operation pressure sensor 29LA detects operational contents of the forward-backward direction for the left operation lever 26L by an operator in the form of pressure and outputs the detected value to the controller 30. The operational contents may be the lever operation direction and the lever operation amount (lever operation angle) or the like, for example.

Similarly, the operation pressure sensor 29LB detects operational contents of the left-right direction for the left operation lever 26L by an operator in the form of pressure and outputs the detected value to the controller 30. The operation pressure sensor 29RA detects operational contents of the forward-backward direction for the right operation lever 26R by an operator in the form of pressure and outputs the detected value to the controller 30. The operation pressure sensor 29RB detects operational contents of the left-right direction by an operator for the right operation lever 26R in the form of pressure and outputs the detected value to the controller 30. The operation pressure sensor 29DL detects operational contents of the forward-backward direction for the left drive lever 26DL by an operator in the form of pressure and outputs the detected value to the controller 30. The operation pressure sensor 29DR detects operational contents of the forward-backward direction for the right drive lever 26DR by an operator in the form of pressure and outputs the detected value to the controller 30.

The controller 30 receives outputs of the operation pressure sensor 29 and feeds a control command to the regulator 13 as needed to change the discharge amount of the main pump 14. Also, the controller 30 receives the outputs of the control pressure sensor 19 provided in the upstream of a throttle 18 and outputs a control command to the regulator 13 to change the discharge amount of the main pump 14 as needed. The throttle 18 includes a left throttle 18L and a right throttle 18R, and the control pressure sensor 19 includes a left control pressure sensor 19L and a right control pressure sensor 19R.

A left throttle 18L is disposed between the control valve 176L, which is the most downstream, and the hydraulic oil tank in the left center bypass line 40L. Therefore, the flow of the hydraulic oil discharged by the left main pump 14L is limited by the left throttle 18L. The left throttle 18L generates the control pressure for controlling the left regulator 13L. The left control pressure sensor 19L is a sensor for detecting the control pressure and outputs a detected value to the controller 30. The controller 30 controls the discharge amount of the left main pump 14L by adjusting the swash-plate tilt angle of the left main pump 14L corresponding to the control pressure. The controller 30 decreases a larger discharge amount of the left main pump 14L as the control pressure is higher, and increases a larger discharge amount of the left main pump 14L as the control pressure is lower. The discharge amount of the right main pump 14R is similarly controlled.

Specifically, if the hydraulic actuators in the shovel 100 are in a standby state where none of the hydraulic actuators is operated as shown in FIG. 2, the hydraulic oil discharged by the left main pump 14L passes through the left center bypass line 40L and reaches the left throttle 18L. The flow of hydraulic oil discharged by the left main pump 14L increases the control pressure generated in the upstream of the left throttle 18L. As a result, the controller 30 decreases the discharge amount of the left main pump 14L to an allowable minimum discharge amount to suppress a pressure loss (pumping loss) caused by the hydraulic oil discharged by the left main pump 14L passing through the left center bypass line 40L. On the other hand, if any of the hydraulic actuators is operated, the hydraulic oil discharged by the left main pump 14L flows into a to-be-operated hydraulic actuator through a control valve corresponding to the to-be-operated hydraulic actuator. Then, the flow of the hydraulic oil discharged by the left main pump 14L decreases or disappears the amount reaching the left throttle 18L, thereby lowering the control pressure generated in the upstream of the left throttle 18L. As a result, the controller 30 increases the discharge amount of the left main pump 14L and allows an sufficient amount of the hydraulic oil to flow into the to-be-operated hydraulic actuator so as to ensure that the to-be-operated hydraulic actuator can operate. Note that the controller 30 controls the discharge amount of the right main pump 14R in the same manner.

According to the arrangement sated above, the hydraulic system in FIG. 2 can reduce energy consumption wasted for the main pump 14 in the standby mode. The wasteful energy consumption includes a pumping loss caused by the hydraulic oil discharged by the main pump 14 in the center bypass line 40. Also, if a hydraulic actuator is operated, the hydraulic system in FIG. 2 ensures that a necessary and sufficient amount of the hydraulic oil can be supplied from the main pump 14 to the to-be-operated hydraulic actuator.

Figure 3A:
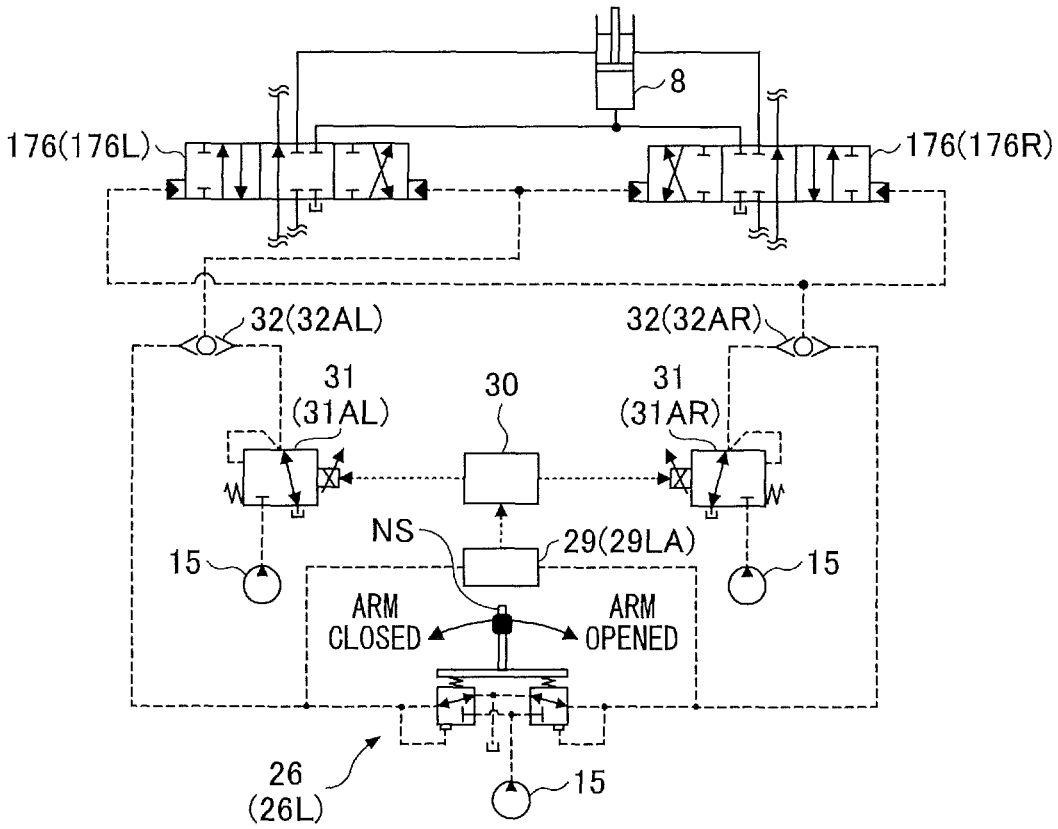
FIG. 3A is a diagram of a portion of the hydraulic system related to operations for an arm cylinder.
Figure 3B:
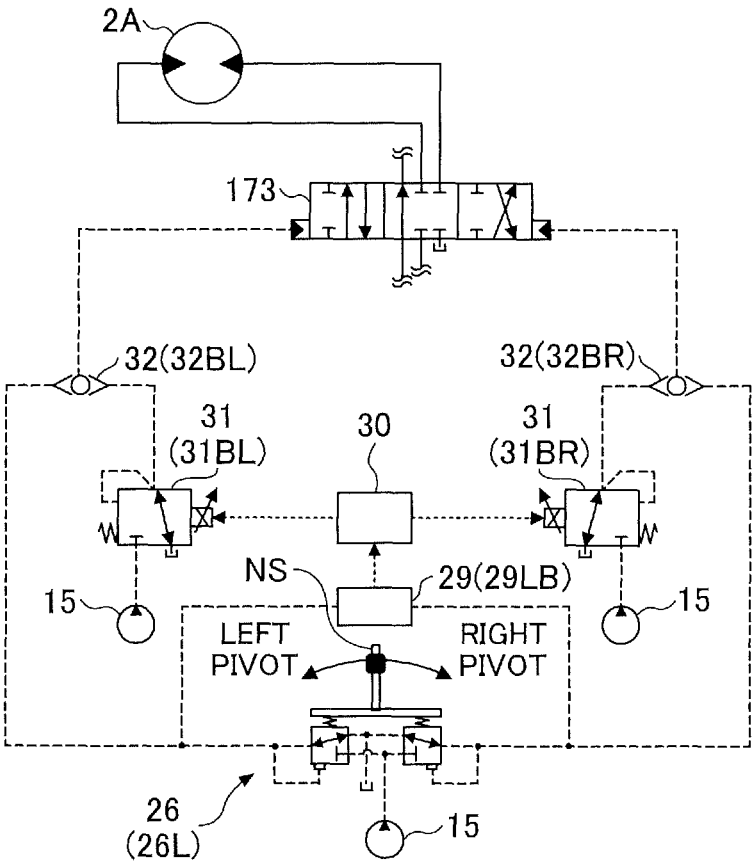
FIG. 3B is a diagram of a portion of the hydraulic system related to operations for a pivot hydraulic motor.
Figure 3C:
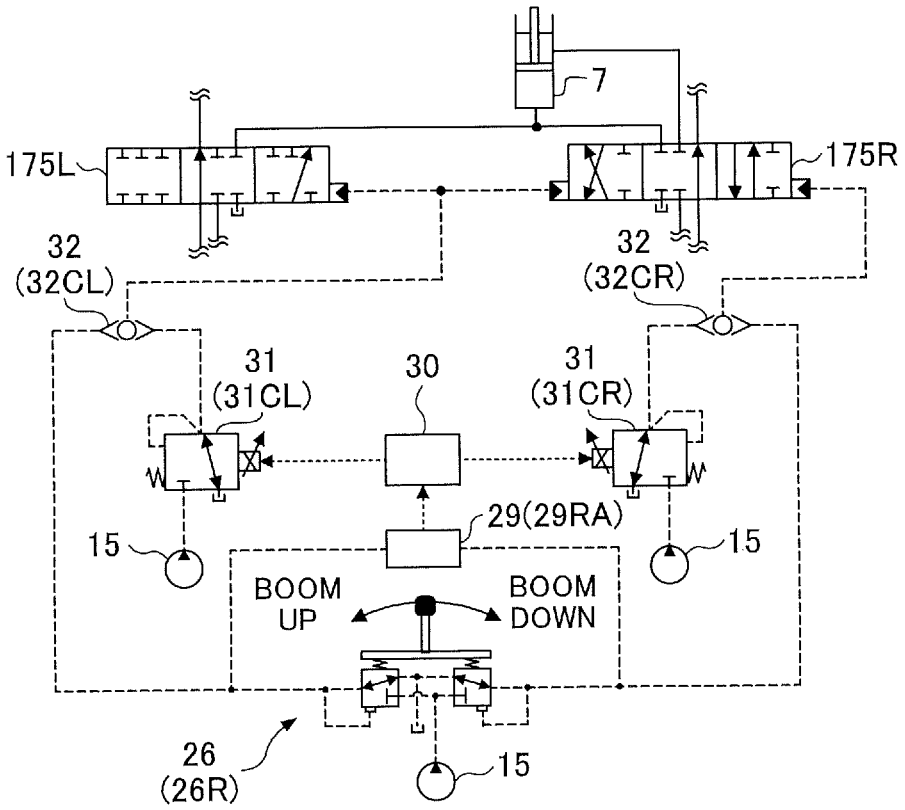
FIG. 3C is a diagram of a portion of the hydraulic system related to operations for a boom cylinder.
Figure 3D:
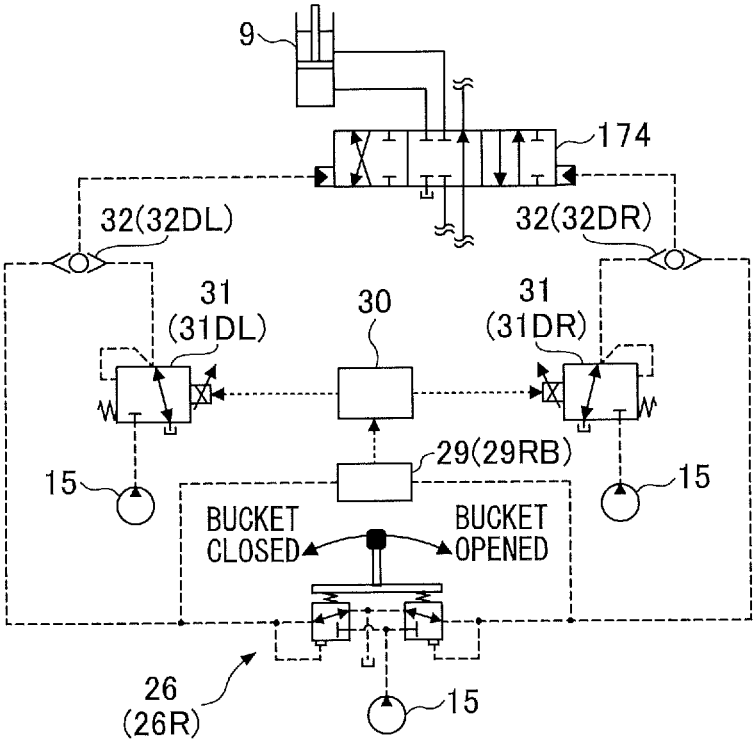
FIG. 3D is a diagram of a portion of the hydraulic system related to operations for a bucket cylinder.

Next, an arrangement for enabling the controller 30 to automatically operate an actuator by means of a machine control function is described with reference to FIGS. 3A to 3D. FIGS. 3A to 3D are views of portions of a hydraulic system. Specifically, FIG. 3A is a view of a portion of the hydraulic system related to operations of the arm cylinder 8, and FIG. 3B is a view of a portion of the hydraulic system related to operations of the pivot hydraulic motor 2A. Also, FIG. 3C is a view of a portion of the hydraulic system related to operations of the boom cylinder 7, and FIG. 3D is a view of a portion of the hydraulic system related to operations of the bucket cylinder 9.

As shown in FIGS. 3A to 3D, the hydraulic system includes a proportional valve 31 and a shuttle valve 32. The proportional valve 31 includes proportional valves 31AL to 31DL and 31AR to 31DR, and the shuttle valve 32 includes shuttle valves 32AL to 32DL and 32AR to 32DR.

The proportional valve 31 is configured to function as a machine control valve. The proportional valve 31 is disposed in a conduit that connects the pilot pump 15 to the shuttle valve 32 and is configured to cause the flow line area of the conduit to be variable. In this embodiment, the proportional valve 31 operates in response to a control command output by the controller 30. Thus, the controller 30 can supply the hydraulic oil discharged by the pilot pump 15 to a pilot port of the corresponding control valve in the control valve 17 via the proportional valve 31 and the shuttle valve 32, regardless of operator's operations of the operation device 26.

The shuttle valve 32 has two inlet ports and one outlet port. One of the two inlet ports is connected to the operation device 26, and the other is connected to the proportional valve 31. The outlet port is connected to the pilot port of the corresponding control valve in control valve 17. Thus, the shuttle valve 32 can apply the higher one of the pilot pressure generated by the operation device 26 and the pilot pressure generated by the proportional valve 31 to the pilot port of the corresponding control valve.

According to this arrangement, even if no operation is performed on the particular operation device 26, the controller 30 can operate a hydraulic actuator corresponding to the particular operation device 26.

For example, as shown in FIG. 3A, the left operation lever 26L is used to operate the arm 5. Specifically, the left operation lever 26L utilizes the hydraulic oil discharged by the pilot pump 15 to apply the pilot pressure corresponding to operations in the forward-backward direction to a pilot port of the control valve 176. More specifically, if the left operation lever 26L is operated in the arm closing direction (backward direction), the left operation lever 26L applies the pilot pressure corresponding to the operation amount to a right pilot port of the control valve 176L and a left pilot port of the control valve 176R. Also, if the left operation lever 26L is operated in the arm opening direction (forward direction), the left operation lever 26L applies the pilot pressure corresponding to the operation amount to a left pilot port of the control valve 176L and a right pilot port of the control valve 176R.

A switch NS is provided to the left operation lever 26L. In this embodiment, the switch NS is a push-button switch. An operator can operate the left operation lever 26L with a hand while pushing the switch NS with a finger. The switch NS may be provided to the right operation lever 26R or at other positions in the cabin 10.

The operation pressure sensor 29LA detects operational contents for the left operation level 26L in the forward-backward direction by an operator in the form of pressure and outputs the detected value to the controller 30.

The proportional valve 31AL operates in response to a current command fed from the controller 30. Then, the proportional valve 31AL adjusts the pilot pressure caused by the hydraulic oil introduced from the pilot pump 15 to a right pilot port of the control valve 176L and a left pilot port of the control valve 176R through the proportional valve 31AL and the shuttle valve 32AL. The proportional valve 31AR operates in response to a current command fed from the controller 30. Then, the proportional valve 31AR adjusts the pilot pressure caused by the hydraulic oil introduced from the pilot pump 15 to a left pilot port of the control valve 176L and a right pilot port of the control valve 176R through the proportional valve 31AR and the shuttle valve 32AR. The proportional valve 31AL can adjust the pilot pressure so that the control valve 176L can be stopped at any valve position. Also, the proportional valve 31AR can adjust the pilot pressure so that the control valve 176R can be stopped at any valve position.

According to this arrangement, the controller 30 can supply the hydraulic oil discharged by the pilot pump 15 to the right pilot port of the control valve 176L and the left pilot port of the control valve 176R through the proportional valve 31AL and the shuttle valve 32AL, regardless of arm closing operations by an operator. Namely, the controller 30 can automatically close the arm 5. Also, the controller 30 may supply the hydraulic oil discharged by the pilot pump 15 to the left pilot port of the control valve 176L and the right pilot port of the control valve 176R through the proportional valve 31AR and shuttle valve 32AR, regardless of arm opening operations by the operator. Namely, the controller 30 can automatically open the arm 5.

Also, as shown in FIG. 3B, the left operation lever 26L is used to operate the pivot mechanism 2. Specifically, the left operation lever 26L utilizes the hydraulic oil discharged by the pilot pump 15 to apply the pilot pressure corresponding to operations in the left-right direction to a pilot port of the control valve 173. More specifically, if the left operation lever 26L is operated in the left turn direction (left direction), the left operation lever 26L applies the pilot pressure corresponding to the operation amount to the left pilot port of the control valve 173. Also, if the left operation lever 26L is operated in the right turn direction (right direction), the left operation lever 26L applies the pilot pressure corresponding to the operation amount to the right pilot port of the control valve 173.

The operation pressure sensor 29LB detects operational contents for the left operation lever 26L by an operator in the left-right direction in the form of pressure and outputs the detected value to the controller 30.

The proportional valve 31BL operates in response to a current command fed from the controller 30. Then, the proportional valve 31BL adjusts the pilot pressure caused by the hydraulic oil introduced from the pilot pump 15 to the left pilot port of the control valve 173 through the proportional valve 31BL and shuttle valve 32BL. The proportional valve 31BR operates in response to a current command fed from the controller 30. Then, the proportional valve 31BR adjusts the pilot pressure caused by the hydraulic oil introduced from the pilot pump 15 to the right pilot port of the control valve 173 through the proportional valve 31BR and the shuttle valve 32BR. The proportional valve 31BL and the proportional valve 31BR can adjust the pilot pressure so that the control valve 173 can be stopped at any valve position.

According to this arrangement, the controller 30 can supply the hydraulic oil discharged by the pilot pump 15 to the left pilot port of the control valve 173 via the proportional valve 31BL and shuttle valve 32BL, regardless of the operator's left turn operation. Namely, the controller 30 can automatically turn the pivot mechanism 2 to the left direction. Also, the controller 30 may supply the hydraulic oil discharged by the pilot pump 15 to the right pilot port of the control valve 173 through the proportional valve 31BR and the shuttle valve 32BR regardless of the operator's right turn operation. Namely, the controller 30 can automatically turn the pivot mechanism 2 to the right direction.

Also, as shown in FIG. 3C, the right operation lever 26R is used to operate the boom 4. Specifically, the right operation lever 26R utilizes the hydraulic oil discharged by the pilot pump 15 to apply the pilot pressure corresponding to operations in the forward-backward direction to the pilot port of the control valve 175. More specifically, if the right operation lever 26R is operated in the boom up direction (backward direction), the right operation lever 26R applies the pilot pressure corresponding to the operation amount to the right pilot port of the control valve 175L and the left pilot port of the control valve 175R. Also, if the right operation lever 26R is operated in the boom down direction (forward direction), the right operation lever 26R applies the pilot pressure corresponding to the operation amount to the right pilot port of the control valve 175R.

The operation pressure sensor 29RA detects operational contents for the right operation lever 26R by an operator in the forward-backward operation in the form of pressure and outputs the detected value to the controller 30.

The proportional valve 31CL operates in response to a current command fed from the controller 30. Then, the proportional valve 31CL adjusts the pilot pressure caused by the hydraulic oil introduced from the pilot pump 15 to the right pilot port of the control valve 175L and the left pilot port of the control valve 175R through the proportional valve 31CL and the shuttle valve 32CL. The proportional valve 31CR operates in response to a current command fed from the controller 30. Then, the proportional valve 31CR adjusts the pilot pressure caused by the hydraulic oil introduced from the pilot pump 15 to the left pilot port of the control valve 175L and the right pilot port of the control valve 175R through the proportional valve 31CR and the shuttle valve 32CR. The proportional valve 31CL can adjust the pilot pressure so that the control valve 175L can be stopped at any valve position. The proportional valve 31CR can also adjust the pilot pressure so that the control valve 175R can be stopped at any valve position.

According to this arrangement, the controller 30 can supply the hydraulic oil discharged by the pilot pump 15 to the right pilot port of the control valve 175L and the left pilot port of the control valve 175R through the proportional valve 31CL and shuttle valve 32CL, regardless of operator's boom up operations. Namely, the controller 30 can automatically raise the boom 4. Also, the controller 30 can supply the hydraulic oil discharged by the pilot pump 15 to the right pilot port of the control valve 175R through the proportional valve 31CR and the shuttle valve 32CR regardless of operator's boom down operations. Namely, the controller 30 can automatically lower the boom 4.

Also, as shown in FIG. 3D, the right operation lever 26R is used to operate the bucket 6. Specifically, the right operation lever 26R utilizes the hydraulic oil discharged by the pilot pump 15 to apply the pilot pressure corresponding to operations in the left-right direction to the pilot port of the control valve 174. More specifically, if the right operation lever 26R is operated in the bucket closing direction (left direction), the right operation lever 26R applies the pilot pressure corresponding to the operation amount to the left pilot port of the control valve 174. Also, if the right operation lever 26R is operated in the bucket opening direction (right direction), the right operation lever 26R applies the pilot pressure corresponding to the operation amount to the right pilot port of the control valve 174.

The operation pressure sensor 29RB detects operational contents for the right operation lever 26R by an operator in the left-right direction in the form of pressure and outputs the detected value to the controller 30.

The proportional valve 31DL operates in response to a current command fed from the controller 30. Then, the proportional valve 31DL adjusts the pilot pressure caused by the hydraulic oil introduced from the pilot pump 15 to the left pilot port of the control valve 174 through the proportional valve 31DL and the shuttle valve 32DL. The proportional valve 31DR operates in response to a current command fed from the controller 30. Then, the proportional valve 31DR adjusts the pilot pressure caused by the hydraulic oil introduced from the pilot pump 15 to the right pilot port of the control valve 174 through the proportional valve 31DR and the shuttle valve 32DR. The proportional valves 31DL and 31DR can adjust the pilot pressure so that the control valve 174 can be stopped at any valve position.

According to this arrangement, the controller 30 can supply the hydraulic oil discharged by the pilot pump 15 to the left pilot port of the control valve 174 via the proportional valve 31DL and the shuttle valve 32DL regardless of operator's bucket closing operations. Namely, the controller 30 can automatically close the bucket 6. Also, the controller 30 may supply the hydraulic oil discharged by the pilot pump 15 to the right pilot port of the control valve 174 through the proportional valve 31DR and the shuttle valve 32DR, regardless of the operator's bucket opening operations. Namely, the controller 30 can automatically open the bucket 6.

The shovel 100 may be configured to automatically advance and reverse the lower travelling object 1. In this case, portions in the hydraulic system related to operations of the left travelling hydraulic motor 1L and the right travelling hydraulic motor 1R may be configured in the same way as a portion related to operations of the boom cylinder 7.

Figure 4:
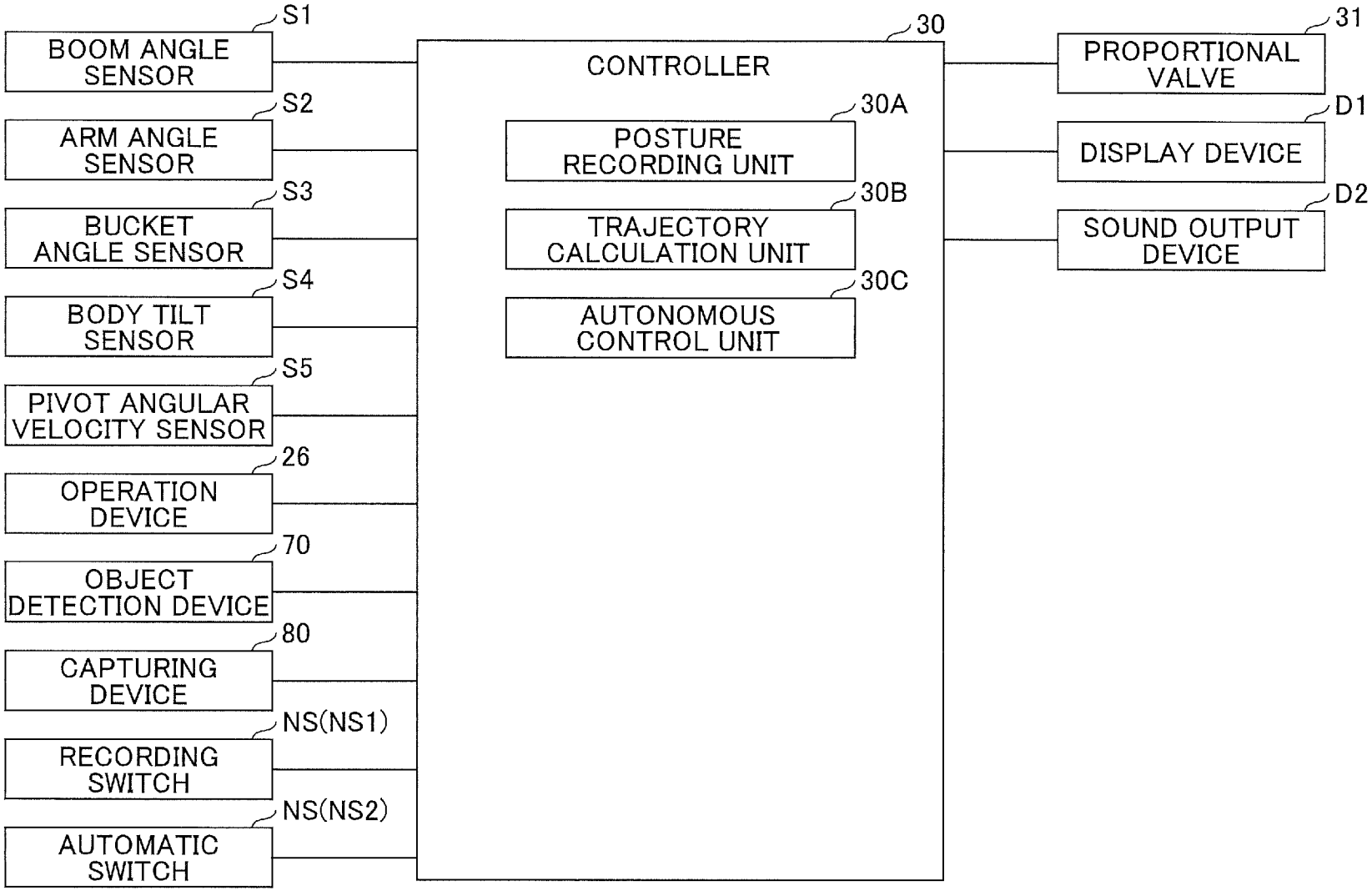
FIG. 4 is a functional block diagram of a controller.

Next, functions of the controller 30 are described with reference to FIG. 4. FIG. 4 is a functional block diagram of a controller 30. In the example of FIG. 4, the controller 30 is configured to receive signals fed from the posture detection device, the operation device 26, the object detection device 70, the capturing device 80 and the switch NS, and the like and perform various calculations to output control commands to the proportional valve 31, the display device D1 and the sound output device D2. The posture detection device may include, for example, a boom angle sensor S1, an arm angle sensor S2, a bucket angle sensor S3, a body tilt sensor S4 and a pivot angular velocity sensor S5. The switch NS includes a recording switch NS1 and an automatic switch NS2. The controller 30 has a posture recording unit 30A, a trajectory calculation unit 30B and an autonomous control unit 30C as functional elements. Each functional element may be arranged with hardware or software.

The posture recording unit 30A is configured to record information regarding the posture of the shovel 100. In this embodiment, the posture recording unit 30A records the information regarding the posture of the shovel 100 in the RAM at the timing of the recording switch NS1 being pressed. Specifically, the posture recording unit 30A records an output from the posture detection device every time the recording switch NS1 is pressed. The posture recording unit 30A may be configured to start the recording when the recording switch NS1 is pressed at a first time point and to terminate the recording when the recording switch NS1 is pressed at a second time point. In this case, the posture recording unit 30A may repeatedly record the information regarding the posture of the shovel 100 at a predetermined control cycle spanning from the first time point to the second time point.

The trajectory calculation unit 30B is configured to calculate a target trajectory as a trajectory drawn for a predetermined portion of the shovel 100 when the shovel 100 is operated autonomously. The predetermined portion may be, for example, a predetermined point on the back surface of the bucket 6. In the present embodiment, the trajectory calculation unit 30B calculates a target trajectory used when the autonomous control unit 30C autonomously operates the shovel 100. Specifically, the trajectory calculation unit 30B calculates the target trajectory based on the information regarding the posture of the shovel 100 recorded by the posture recording unit 30A.

The autonomous control unit 30C is configured to operate the shovel 100 autonomously. In this embodiment, the autonomous control unit 30C is configured to, if a predetermined activation condition is satisfied, move a predetermined portion of the shovel 100 along a target trajectory calculated by the target trajectory unit 30B. Specifically, the autonomous control unit 30C operates the shovel 100 autonomously so that, when the operation device 26 is operated during the automatic switch NS2 being pressed, the predetermined portion of the shovel 100 moves along the target trajectory.

Figure 5:
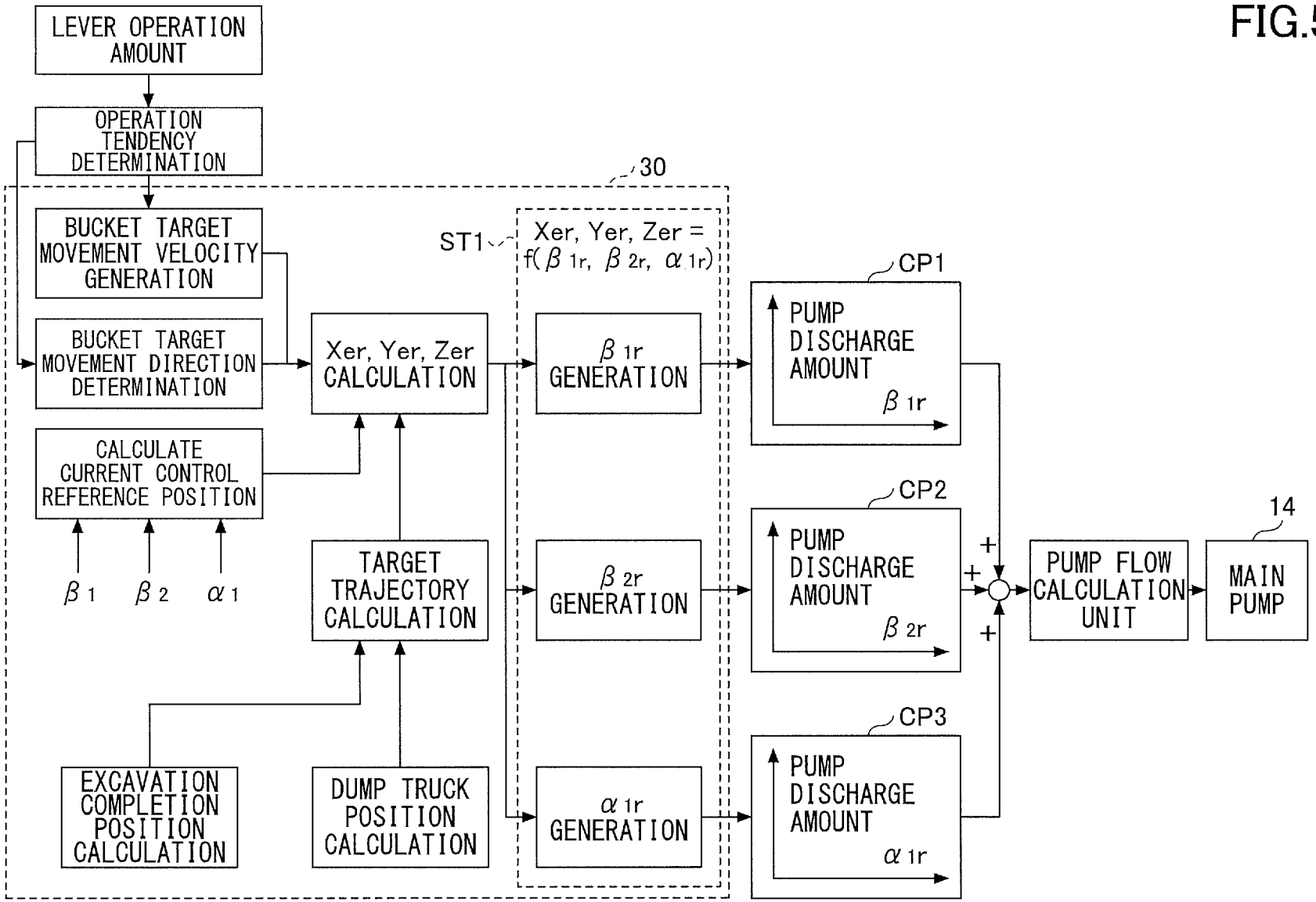
FIG. 5 is a block diagram of an autonomous control function.
Figure 6:
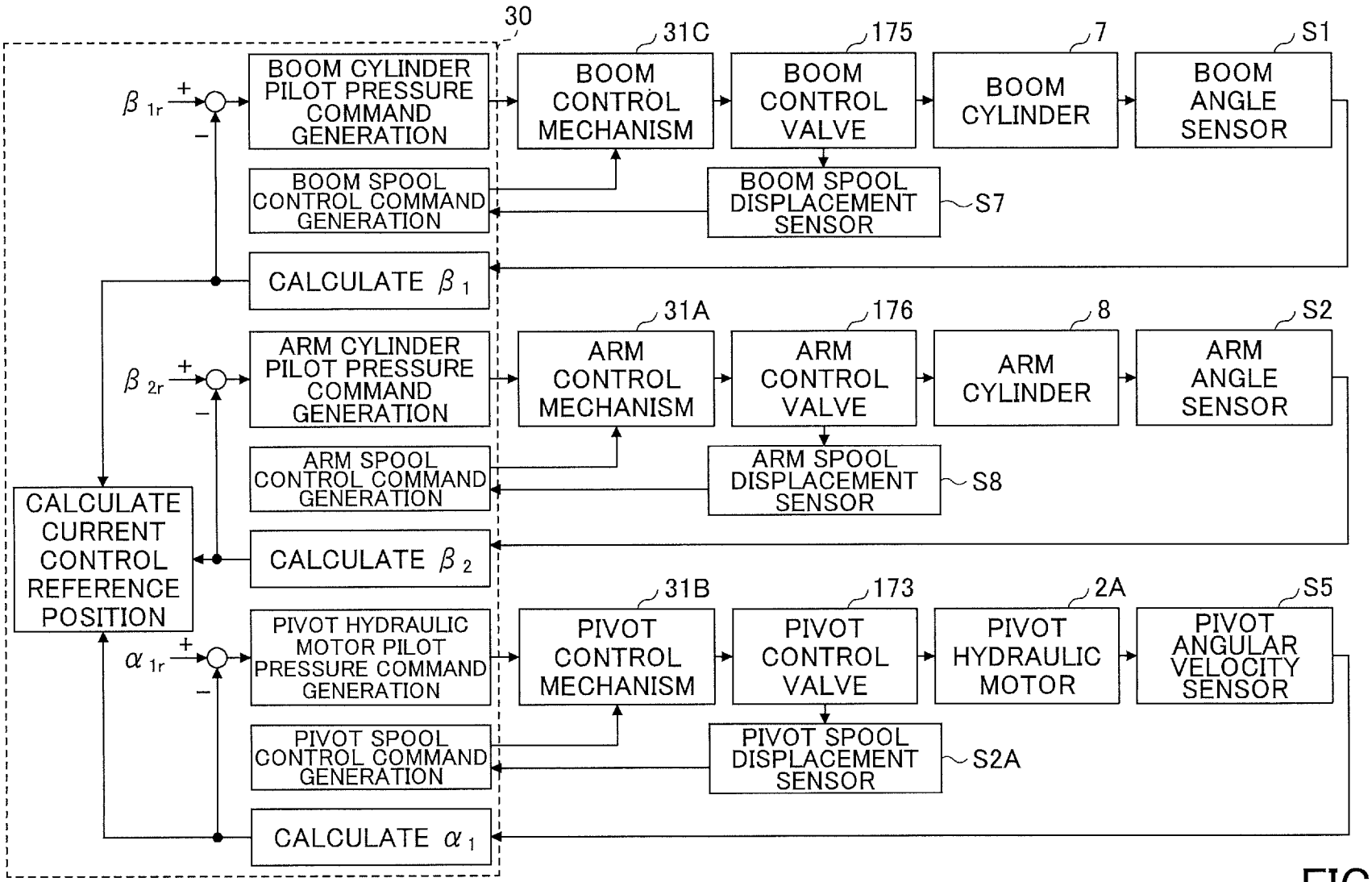
FIG. 6 is a block diagram of an autonomous control function.

Next, one exemplary function for the controller 30 to autonomously control movement of an attachment (which is referred to as an "autonomous control function" hereinafter) is described with reference to FIGS. 5 and 6. FIGS. 5 and 6 are block diagrams of the autonomous control function.

Initially, the controller 30 generates a bucket target movement velocity based on an operation tendency and determines the bucket target movement direction, as shown in FIG. 5. The operation tendency is determined, for example, based on the lever operation amount. The bucket target movement velocity is a target value of the movement velocity of a control reference point in the bucket 6, and the bucket target movement direction is a target value of the movement direction of the control reference point in the bucket 6. The control reference point in the bucket 6 may be a predetermined point on the back surface of bucket 6, for example. The current control reference position in FIG. 5 is the current position of the control reference point and may be calculated based on the boom angle $\beta_1$, the arm angle $\beta_2$ and the pivot angle $\alpha_1$. The controller 30 may further utilize the bucket angle $\beta_3$ to calculate the current control reference position.

Then, the controller 30 calculates three-dimensional coordinates (Xer, Yer, and Zer) of a control reference position after passage of the unit time based on the bucket target movement velocity, the bucket target movement direction and the three-dimensional coordinates (Xe, Ye, and Ze) of the current control reference position. The three-dimensional coordinates (Xer, Yer, Zer) of the control reference position after passage of the unit time may be, for example, coordinates on the target trajectory. The unit time may be, for example, a time equal to an integral multiple of the control cycle. The target trajectory may be, for example, a target trajectory for a loading operation that is a work to realize loading of earth and sand into a dump truck. In this case, the target trajectory may be calculated based on, for example, the position of the dump truck and an excavation completion position that is the position of the control reference point when the excavation operation has been completed. Note that the position of the dump truck may be calculated based on, for example, an output of at least one of the object detection device 70 and the capturing device 80, and the excavation completion position may be calculated based on, for example, an output of the posture detection device. The excavation completion position may be calculated based on an output of at least one of the object detection device 70 and the capturing device 80.

Then, the controller 30 generates command values $\beta_{1r}$ and $\beta_{2r}$ for rotation of the boom 4 and the arm 5 and a command values $\alpha_{1r}$ for pivot of the upper pivot body 3 based on the calculated three-dimensional coordinates (Xer, Yer, and Zer). The command value $\beta_{1r}$ represents the boom angle $\beta_1$ when the control reference position has been aligned to the three-dimensional coordinates (Xer, Yer, and Zer), for example. Similarly, the command value $\beta_{2r}$ represents the arm angle $\beta_2$ when the control reference position has been aligned to the three-dimensional coordinates (Xer, Yer, and Zer), and the command value $\alpha_{1r}$ represents the pivot angle $\alpha_1$ when the control reference position has been aligned to the three-dimensional coordinates (Xer, Yer, and Zer).

Then, as shown in FIG. 6, the controller 30 operates the boom cylinder 7, the arm cylinder 8 and the pivot hydraulic motor 2A so that the boom angle $\beta_1$, the arm angle $\beta_2$ and the pivot angle $\alpha_1$ are equal to the generated command values $\beta_{1r}$, $\beta_{2r}$ and $\alpha_{1r}$, respectively. Note that the pivot angle $\alpha_1$ is calculated based on an output of the pivot angular velocity sensor S5, for example.

Specifically, the controller 30 generates a boom cylinder pilot pressure command corresponding to the difference $\Delta\beta_1$ between the current value of the boom angle $\beta_1$ and the command value $\beta_{1r}$. Then, a control current corresponding to the boom cylinder pilot pressure command is fed to the boom control mechanism 31C. The boom control mechanism 31C is configured so that the pilot pressure corresponding to the control current corresponding to the boom cylinder pilot pressure command can be applied to the control valve 175 as the boom control valve. The boom control mechanism 31C may be, for example, the proportional valve 31CL and the proportional valve 31CR in FIG. 3C.

Then, upon receiving the pilot pressure generated by the boom control mechanism 31C, the control valve 175 causes the hydraulic oil discharged by the main pump 14 to flow into the boom cylinder 7 in a flow direction and a flow amount corresponding to the pilot pressure.

At this time, the controller 30 may generate a boom spool control command based on a spool displacement amount of the control valve 175 detected by a boom spool displacement sensor S7. The boom spool displacement sensor S7 is a sensor that detects the displacement amount of the spool constituting the control valve 175. The controller 30 may feed a control current corresponding to a boom spool control command to the boom control mechanism 31C. In this case, the boom control mechanism 31C applies the pilot pressure corresponding to the control current corresponding to the boom spool control command to the control valve 175.

The boom cylinder 7 extends or contracts by the hydraulic oil supplied through the control valve 175. The boom angle sensor S1 detects the boom angle $\beta_1$ of the boom 4 driven by the expanding or contracting boom cylinder 7.

Then, the controller 30 feeds back the boom angle $\beta_1$ detected by the boom angle sensor S1 as the current value of the boom angle $\beta_1$ used to generate the boom cylinder pilot pressure command.

The above description relates to the operation of the boom 4 based on the command value $\beta_{1r}$ but it is equally applicable to the operation of the arm 5 based on the command value $\beta_{2r}$ and the pivot operation of the upper pivot body 3 based on the command value $\alpha_{1r}$. The arm control mechanism 31A is configured so that the pilot pressure corresponding to the control current corresponding to the arm cylinder pilot pressure command can be applied to the control valve 176 serving as the arm control valve. The arm control mechanism 31A may be, for example, the proportional valve 31AL and the proportional valve 31AR in FIG. 3A. In addition, the pivot control mechanism 31B is configured so that the pilot pressure corresponding to the control current corresponding to the pivot hydraulic motor pilot pressure command can be applied to the control valve 173 serving as a pivot control valve. The pivot control mechanism 31B may be, for example, the proportional valve 31BL and the proportional valve 31BR in FIG. 3B. Also, the arm spool displacement sensor S8 is a sensor for detecting the displacement amount of the spool constituting the control valve 176, and the pivot spool displacement sensor S2A is a sensor for detecting the displacement amount of the spool constituting the control valve 173.

As shown in FIG. 5, the controller 30 may use pump discharge amount deriving units CP1, CP2 and CP3 to derive the pump discharge amount from the command values $\beta_{1r}$, $\beta_{2r}$ and $\alpha_{1r}$. In this embodiment, the pump discharge amount deriving unit CP1, CP2 and CP3 uses a preregistered reference table or the like to derive the pump discharge amount from the command values $\beta_{1r}$, $\beta_{2r}$ and $\alpha_{1r}$. The pump discharge amounts derived by the pump discharge deriving units CP1, CP2 and CP3 are summed and are fed to a pump flow calculation unit as the total pump discharge amount. The pump flow calculation unit controls the discharge amount of the main pump 14 based on the incoming total pump discharge amount. In this embodiment, the pump flow calculation unit controls the discharge amount of the main pump 14 by changing the swashplate tilt angle of the main pump 14 corresponding to the total pump discharge amount.

In this manner, the controller 30 can simultaneously perform the opening control of the control valve 175 as the boom control valve, the control valve 176 as the arm control valve and the control valve 173 as the pivot control valve and the control of the discharge amount of the main pump 14. Thus, the controller 30 can supply an appropriate amount of the hydraulic oil to each of the boom cylinder 7, the arm cylinder 8 and the pivot hydraulic motor 2A.

Also, the controller 30 performs the autonomous control by calculating the three-dimensional coordinates (Xer, Yer, and Zer), generating the command values $\beta_{1r}$, $\beta_{2r}$ and $\alpha_{1r}$, determining the discharge amount of the main pump 14 as one control cycle, and repeating the control cycle. Also, the controller 30 can improve the accuracy of the autonomous control by performing feedback control on a control reference position based on respective outputs of the boom angle sensor S1, the arm angle sensor S2 and the pivot angle sensor S5. Specifically, the controller 30 can improve the accuracy of the autonomous control by controlling the flow amount of the hydraulic oil flowing into each of the boom cylinder 7, the arm cylinder 8 and the pivot hydraulic motor 2A. Note that the controller 30 may similarly control the flow amount of the hydraulic oil flowing into the bucket cylinder 9.

Figure 7A:
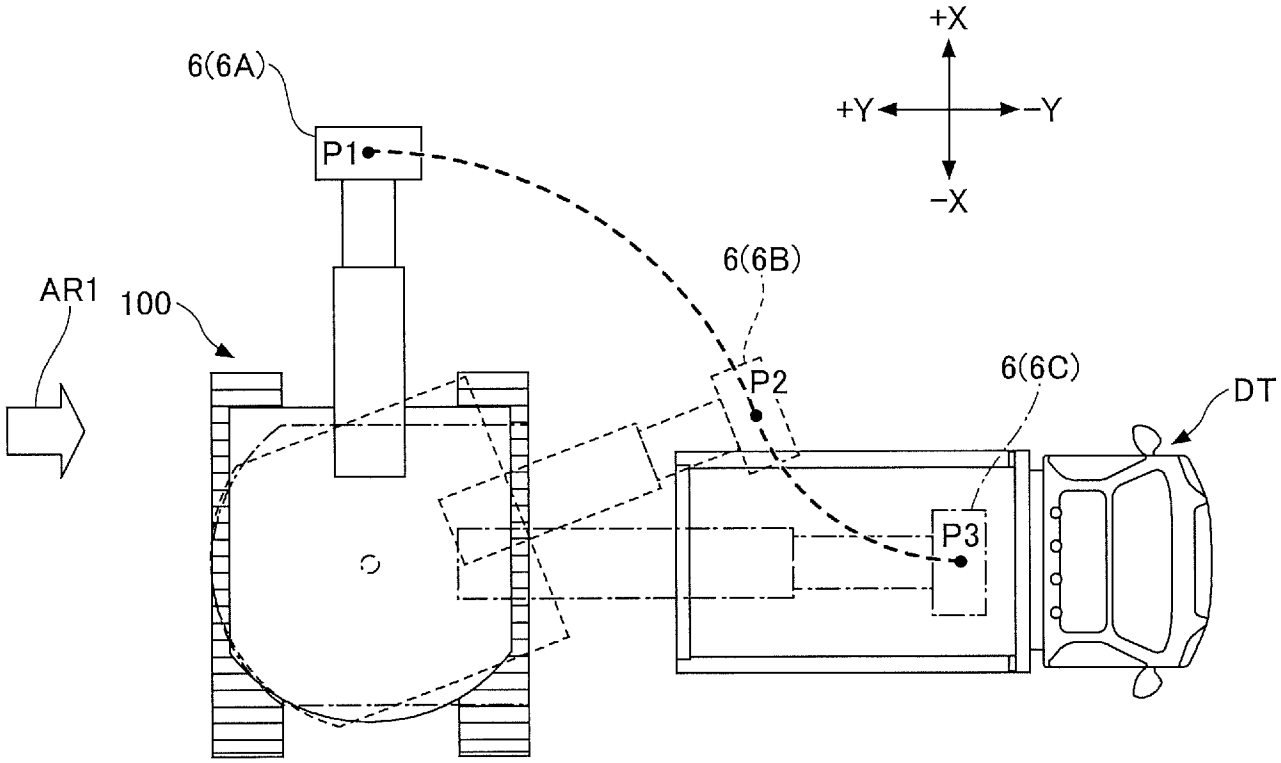
FIG. 7A is a diagram for illustrating one exemplary aspect of a work site.
Figure 7B:
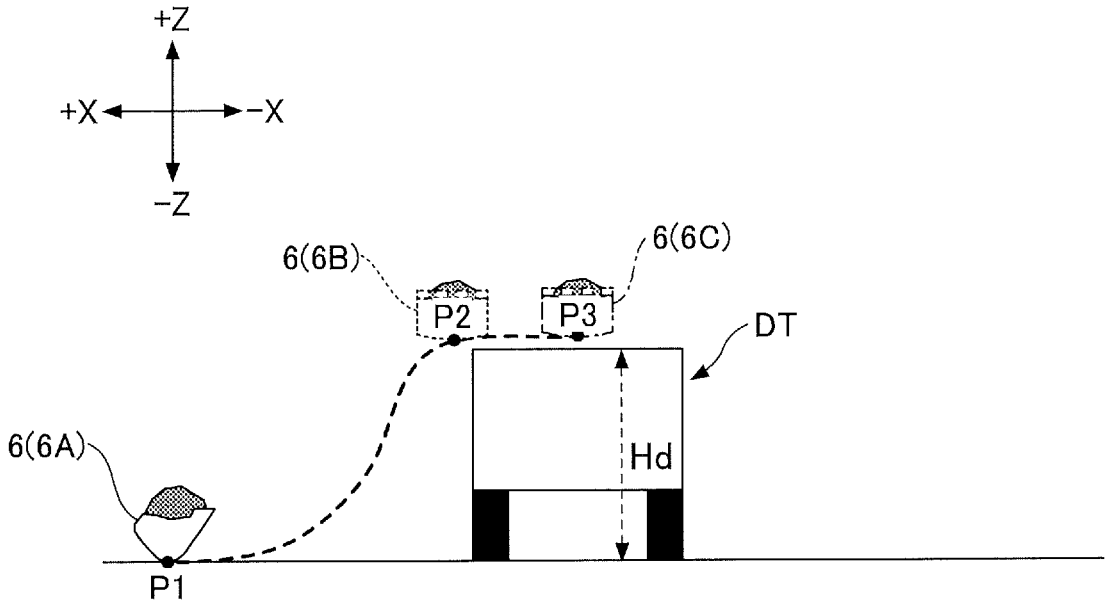
FIG. 7B is a diagram for illustrating one exemplary aspect of a work site.

An operation performed by an operator of the shovel 100 to set a target trajectory is described with reference to FIGS. 7A and 7B. FIGS. 7A and 7B illustrate one exemplary aspect of a work site where earth and sand are loaded into a dump truck DT by a shovel 100. Specifically, FIG. 7A is a top view of the work site. FIG. 7B is a view of the work site viewed from the direction indicated by the arrow AR1 in FIG. 7A. In FIG. 7B, the shovel 100 (except the bucket 6) is not shown for clarity. Also, in FIG. 7A, the shovel 100 drawn as a solid line represents the state of the shovel 100 at completion of an excavation operation, the shovel 100 drawn as a dashed line represents the state of the shovel 100 during a compound operation, and the shovel 100 drawn as a dotted line represents the state of the shovel 100 before the start of an earth removal operation.

Similarly, in FIG. 7B, the bucket 6A drawn as a solid line represents the state of the bucket 6 at completion of the excavation operation, the bucket 6B drawn as a dashed line represents the state of the bucket 6 during the compound operation, and the bucket 6C drawn as a dotted line represents the state of the bucket 6 before the start of the earth removal operation. Also, the thick dashed lines in FIGS. 7A and 7B represent trajectories of a predetermined point on the back surface of the bucket 6.

The operator pushes the recording switch NS1 at completion of the excavation operation to record the posture of the shovel 100 at a start position of the compound operation including a right pivot operation in a RAM. Specifically, an output of the posture detection device when a predetermined point (control reference point) on the back surface of the bucket 6 is at point P1 is recorded in the RAM. The controller 30 may record the point 21 serving as the excavation completion position as the start position of the compound operation including a pivot operation.

Then, the operator uses the operation device 26 to perform the compound operation. In this embodiment, the operator performs the compound operation including a right pivot operation. Specifically, the compound operation including at least one of a boom up operation and an arm closing operation and a right pivot operation is performed until the posture of the shovel 100 becomes one as shown by a dashed line, that is, until the predetermined point on the back surface of the bucket 6 reaches point P2. The compound operation may include an opening-closing operation for the bucket 6. This is to move the bucket 6 above the dump platform while preventing contact between the platform of the dump truck DT having the height Hd and the bucket 6.

Then, the operator performs the compound operation including an arm opening operation and a right pivot operation until the posture of the shovel 100 becomes one as shown by a dotted line, that is, until the predetermined point on the back surface of the bucket 6 reaches point P3. The compound operation may include at least one of an operation of the boom 4 and an opening-closing operation of the bucket 6. This is to allow soil such as earth and sand to be removed from the front side (operator's seat side) of the platform of the dump truck DT.

Then, the operator pushes the recording switch NS1 before the start of the earth removal operation to record the posture of the shovel 100 at the completion position of the compound operation in the RAM. Specifically, an output of the posture detection device when the predetermined point on the back surface of the bucket 6 is at point P3 is recorded in the RAM. The controller 30 may record the point P3 serving as the dump (earth removal) start position as the completion position of the compound operation.

By performing the above-stated sequence of operations, the operator of the shovel 100 can cause the controller 30 to calculate the target trajectory for loading into the dump truck DT by the shovel 100.

Figure 8:
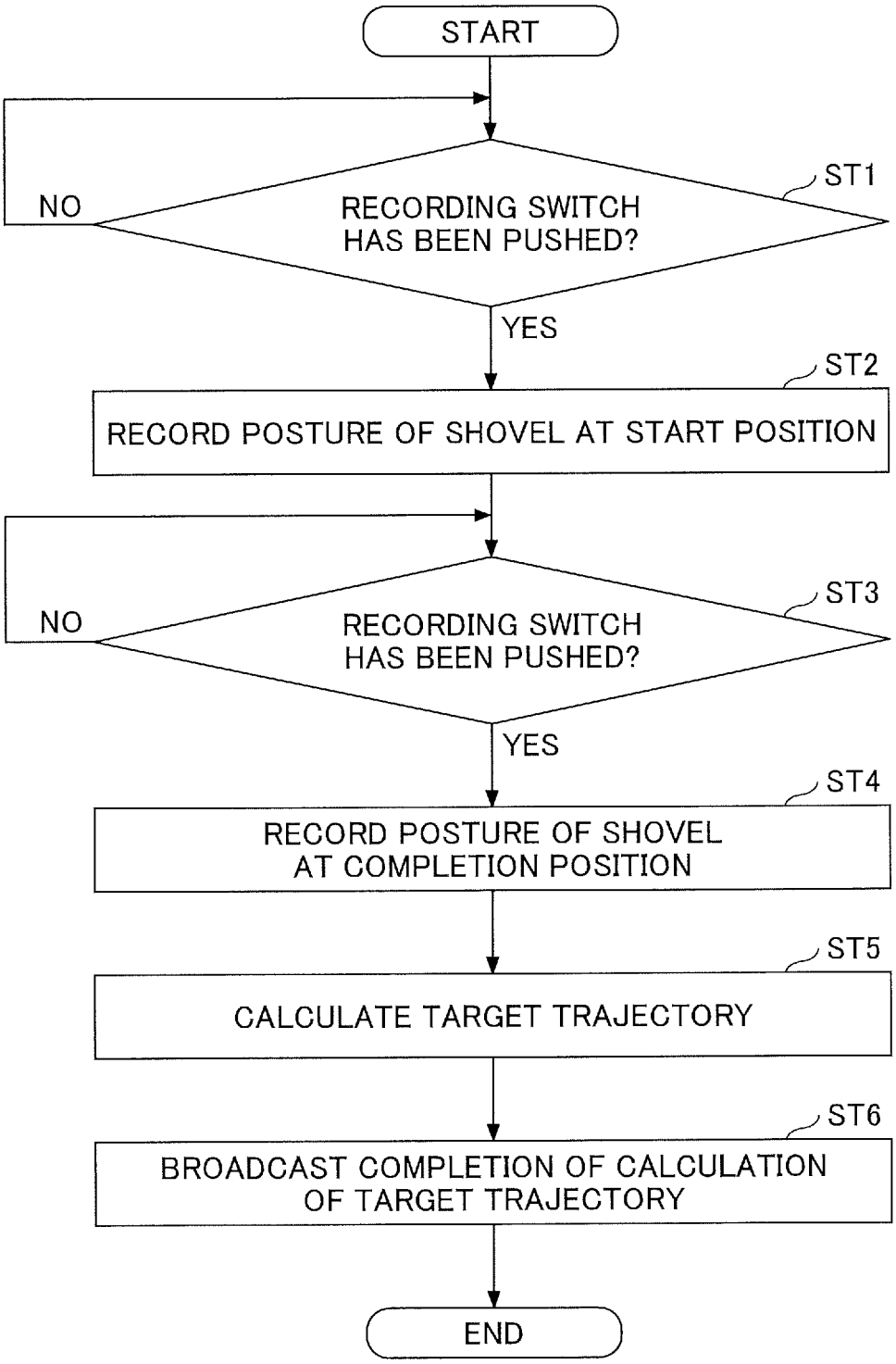
FIG. 8 is a flowchart of one exemplary calculation operation.

Next, an operation (referred to as a "calculation operation" hereinafter) for the controller 30 to calculate the target trajectory related to the loading operation is described with reference to FIG. 8. FIG. 8 is a flowchart for illustrating one exemplary calculation operation. The controller 30 performs this calculation operation at a predetermined control cycle repeatedly, for example, until the target trajectory is calculated.

First, the controller 30 determines whether the recording switch NS1 is pressed (step ST1). The controller 30 performs this determination repeatedly until the operator presses the recording switch NS1 at the start position of the compound operation including a right pivot operation, for example.

If it is determined that the recording switch NS1 is pressed (YES in step ST1), the posture recording unit 30A of the controller 30 records the posture of the shovel 100 at the start position of the compound operation (step ST2). In this embodiment, the posture recording unit 30A records the information regarding the posture of the shovel 100 shown by a solid line in FIG. 7A by recording an output of the posture detection device.

Then, the controller 30 determines whether the recording switch NS1 is pressed (step ST3). The controller 30 performs this determination repeatedly until the operator presses the recording switch NS1 at the completion position of the compound operation, for example.

If it is determined that the recording switch NS1 is pressed (YES in step ST3), the posture recording unit 30A records the posture of the shovel 100 at the completion position of the compound operation (step ST4). In this embodiment, the posture recording unit 30A records the information regarding the posture of the shovel 100 shown by a dashed line in FIG. 7A by recording an output of the posture detection device.

The controller 30 may record an operating velocity of the compound operation. If the work area is narrow, the operator may feel that the operating velocity of the boom up operation relative to the pivot operation is high. Also, if the operator is not familiar with operations of the shovel 100, the operator may feel that the operating velocity of the boom up operation relative to the pivot operation is high. Accordingly, the controller 30 may be configured to record the operating velocity pattern of the compound operation so as to adjust the operating velocity in the autonomous control in accordance with differences of work sites or operators' skills. According to this arrangement, the controller 30 can reduce the operating velocity so as not to cause the operator to feel that the operating velocity is high, for example.

The posture recording unit 30A may repeatedly record outputs of the posture detection device in a predetermined control cycle after the recording switch NS1 is pressed at the start position of the compound operation and before the recording switch NS1 is pressed at the completion position of the compound operation. In this case, the posture recording unit 30A may inform the operator that the recording is in progress so that the operator can recognize that the information regarding the posture of the shovel 100 is being continuously recorded. For example, the posture recording unit 30A may display the fact that the recording is in progress on the display device D1 and may output voice information for indicating this fact from the sound output device D2.

Then, the trajectory calculation unit 30B of the controller 30 calculates the target trajectory (step ST5). In this embodiment, the trajectory calculation unit 30B calculates the target trajectory for the loading operation based on the information regarding the posture of the shovel 100 recorded at the start position of the compound operation and the information regarding the posture of the shovel 100 recorded at the completion position of the compound operation. The trajectory calculation unit 30B may calculate the target trajectory based on the sequence of information regarding the posture of the shovel 100 from the start position to the completion position of the compound operation.

The trajectory calculation unit 30B may calculate the target trajectory by further taking information regarding the dump truck DT into consideration. The information regarding the dump truck DT may be at least one of the height of the bed of the dump truck DT, the orientation of the dump truck DT, the size of the dump truck DT, and the type of dump truck DT or the like, for example. The information regarding the dump truck DT may be acquired using at least one of the object detection device 70 and the capturing device 80, for example. The controller 30 may acquire the information regarding the dump truck DT through at least one of a positioning device, a communication device, or the like.

Then, the controller 30 broadcasts completion of the calculation of the target trajectory (step ST6). In this embodiment, the trajectory calculation unit 30B displays information on the display device D1 for indicating that the calculation of the target trajectory for the loading work has been completed. The trajectory calculation unit 30B may output voice information for indicating completion of the calculation from the sound output device D2.

Upon calculating the target trajectory, the controller 30 can autonomously operate the shovel 100 so that a predetermined portion of the shovel 100 moves along the target trajectory.

The controller 30 may perform the autonomous control based on the recorded operating velocity pattern for the compound operation. In this case, the controller 30 can perform optimal autonomous control based on the operating velocity pattern corresponding to differences of work sites or operators' skills.

Figure 9:
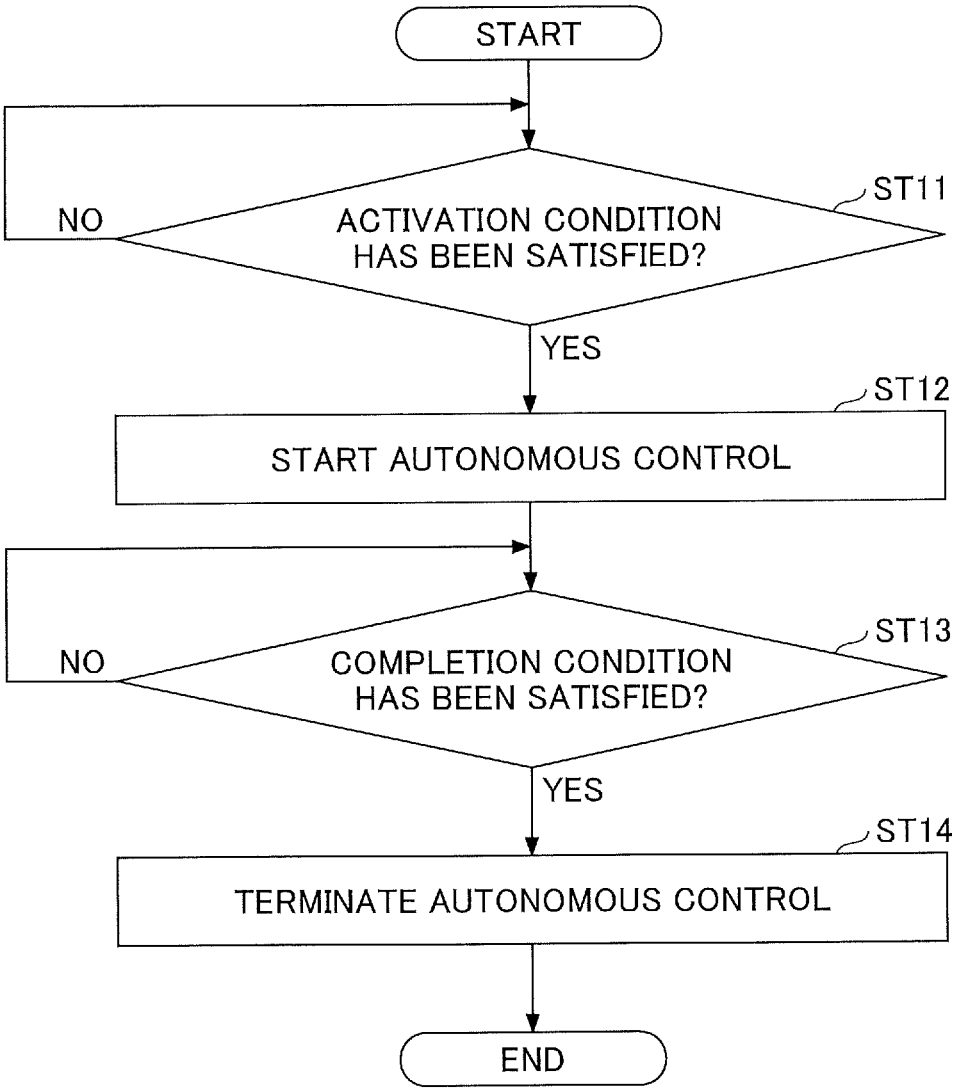
FIG. 9 is a flowchart of one exemplary autonomous operation.

Next, an operation for the controller 30 to cause the shovel 100 to autonomously operate (referred to as an "autonomous operation" hereinafter) is described with reference to FIG. 9. FIG. 9 is a flowchart for illustrating one exemplary autonomous operation.

First, the autonomous control unit 30C of the controller 30 determines whether an activation condition of the autonomous control is satisfied (step ST11). In this embodiment, the autonomous control unit 30C determines whether the activation condition of the autonomous control for loading work is satisfied.

The activation condition may include a first activation condition and a second activation condition, for example. The first activation condition may be that "the target trajectory for loading work has already been calculated", for example. The second activation condition may be that "a pivot operation has been performed while the automatic switch NS2 is pressed", for example. In the example shown in FIGS. 7A and 7B, the "pivot operation" in the second activation condition may be a "right pivot operation." In this case, in the example shown in FIGS. 7A and 7B, even if a left pivot operation is performed while the automatic switch NS2 is pressed, the activation condition is not met. However, the second activation condition may be that "the automatic switch NS2 is pressed." In this case, the activation condition is satisfied regardless of the presence of the pivot operation. Alternatively, the second activation condition may be "the automatic switch NS2 is pressed while the left operation lever 26L is retained in a neutral position." In this case, even in the state where the automatic switch NS2 is pressed, when the left operation lever 26L is operated, the activation condition is not met.

If it is determined that the activation condition is satisfied (YES in step ST11), the autonomous control unit 30C starts the autonomous control (step ST12). In this embodiment, the autonomous control unit 30C automatically raises the boom 4 in accordance with the right pivot operation through a manual operation so that the trajectory drawn by a predetermined point on the back surface of the bucket 6 is along the target trajectory. In this case, the larger the right pivot velocity by the manual operation is, the higher the up velocity of the boom 4 by the autonomous control is. The autonomous control unit 30C may increase or decrease the bucket angle $\beta_3$ to retain the posture of the bucket 6 so that soil or the like caught into the bucket 6 is not caused to fall.

The autonomous control unit 30C may inform an operator that the autonomous control is in progress. For example, the autonomous control unit 30C may display the fact that the autonomous control is in progress on the display device D1 and may output voice information indicating this fact from the sound output device D2.

Then, the autonomous control unit 30C determines whether the autonomous control completion condition is satisfied (step ST13). In this embodiment, the autonomous control unit 30C determines whether the autonomous control completion condition for loading work is satisfied.

The completion condition includes, for example, a first completion condition and a second completion condition. The first completion condition is that "a predetermined part of the shovel 100 has reached a completion position", for example. If the second activation condition is that "a pivot operation is performed while the automatic switch NS2 is pressed", the second completion condition is that "pressing the automatic switch NS2 is stopped" or "the pivot operation is stopped". Also, if the second activation condition is that "the automatic switch NS2 is pressed", the second completion condition is that "the automatic switch NS2 is pressed again", for example. Alternatively, if the second activation condition is that "the automatic switch NS2 is pressed while the left operation lever 26L is retained at a neutral position", the second completion condition is that "pressing the automatic switch NS2 is stopped" or "the pivot operation is performed."

If it is determined that the completion condition is satisfied (YES in step ST13), the autonomous control unit 30C terminates the autonomous control (step ST14). In this embodiment, the autonomous control unit 30C determines that if the first or second completion condition is satisfied, the completion condition is satisfied, and stops all movements of an actuator that are not based on the manual operation.

The autonomous control unit 30C may informs an operator that the autonomous control has been terminated. For example, the autonomous control unit 30C may display the fact that the autonomous control has been terminated on the display device D1 and may output voice information indicating this fact from the sound output device D2.

Then, the operator performs a manually operated earth removal operation to discharge the earth and sand in the bucket 6 to the platform of the dump truck DT. Then, the operator performs a manually operated boom down pivot to restore the posture of an excavation attachment AT to the posture where the excavation operation is possible. Then, the operator restarts the autonomous control after the manually operated excavation operation is performed and new earth and sand or the like have been caught in the bucket 6, and changes the posture of the excavation attachment AT into the posture where the excavation operation is possible. The operator can complete the loading work by repeating these operations.

Figure 10A:
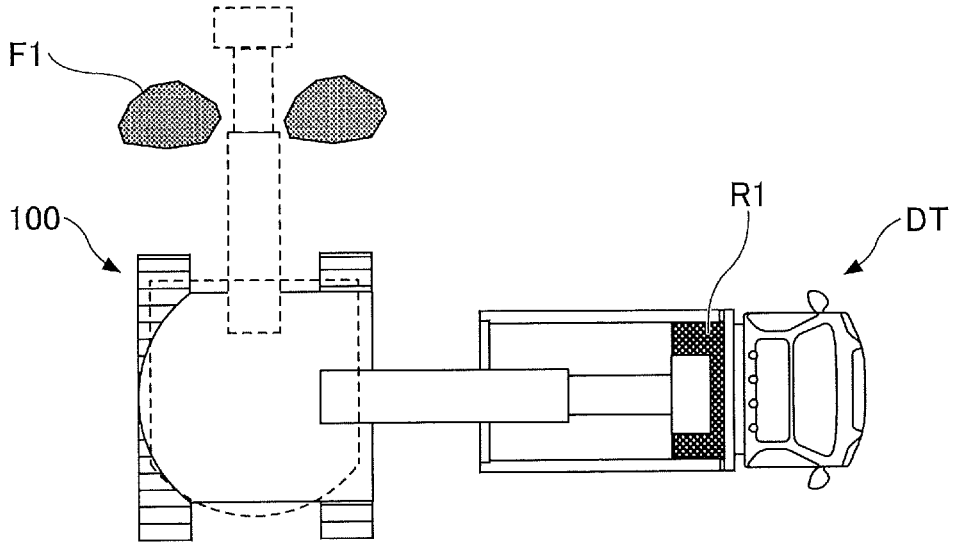
FIG. 10A is a diagram for illustrating another aspect of a work site.
Figure 10B:
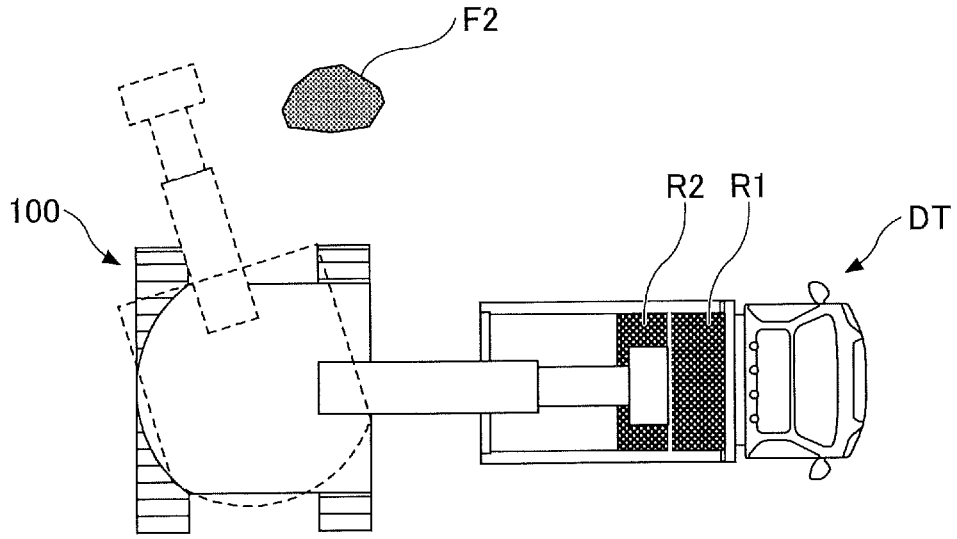
FIG. 10B is a diagram for illustrating another aspect of a work site.
Figure 10C:
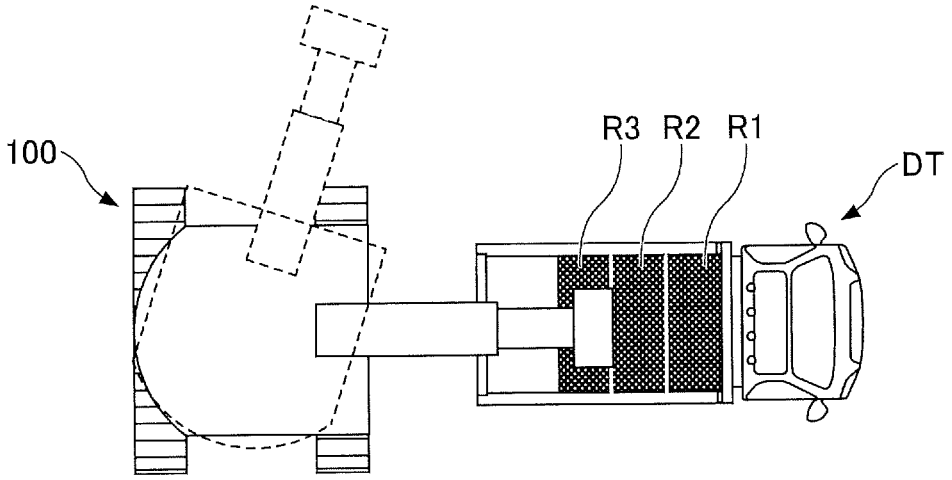
FIG. 10C is a diagram for illustrating another aspect of a work site.

Next, the loading of earth and sand into the dump truck DT by means of the shovel 100 executing the autonomous control is described with reference to FIGS. 10A to 10C. FIGS. 10A to 10C are top views of a work site.

FIG. 10A shows a state where a first manually operated boom up pivot operation has been completed. The boom up pivot operation may include at least one of an arm opening operation, an arm closing operation, a bucket opening operation and a bucket closing operation. A dashed line in FIG.

10A represents the posture of the shovel 100 after completion of a first manually operated excavation operation is completed and before start of a first manually operated boom up pivot operation. Range R1 indicates a range on the platform of the dump truck DT in where the earth and sand are loaded by a manually operated earth removal operation after the first boom up pivot operation.

FIG. 10B shows a state where a second boom up pivot operation in the autonomous control has been completed. A dashed line in FIG. 10B represents the posture of the shovel 100 after completion of a second manually operated excavation operation and before start of a second manually operated boom up pivot operation. Range R2 indicates a range on the platform of the dump truck DT in where the earth and sand are loaded by a manually operated earth removal operation after the second boom up pivot operation.

FIG. 10C shows a state where a third boom up pivot operation in the autonomous control has been completed. A dashed line in FIG. 10C represents the posture of the shovel 100 after completion of a third manually operated excavation operation and before start of a third manually operated boom up pivot operation. Range R3 indicates a range on the platform of the dump truck DT in where the earth and sand are loaded by a manually operated earth removal operation after the third boom up pivot operation.

The operator of the shovel 100 pushes the recording switch NS1 at the time point before the start of the manually operated first boom up pivot operation, that is, at a first time point where the state of the shovel 100 is changed into one indicated in the dotted line in FIG. 10A, to record the information regarding the posture of the shovel 100 at the start position of the compound operation including a pivot operation. Then, the operator performs the compound operation including the boom up operation and the right pivot operation and pushes the recording switch NS1 at a second time point where the state of the shovel 100 is changed into one shown in a solid line in FIG. 10A to record the information regarding the posture of the shovel 100 at the completion position of the compound operation including the pivot operation.

The controller 30 calculates the target trajectory available for the second and subsequent boom up pivot operations in the autonomous control based on the information regarding the posture of the shovel 100 recorded at the first and second time points.

After performing the first earth removal operation, the operator manually performs a boom down pivot operation to bring the bucket 6 close to mound F1 shown in FIG. 10A. Then, the operator manually performs an excavation operation to catch the earth and sand or the like forming the mound F1 in the bucket 6. Then, the operator pushes the automatic switch NS2 at a third time point, where the state of the shovel 100 is changed into one shown in a dotted line in FIG. 10B, to activate the second boom up pivot operation in the autonomous operation rather than the manual operation.

The controller 30 uses the target trajectory calculated at the second time point to perform the second boom up pivot operation in the autonomous control. Specifically, the controller 30 automatically pivots the pivot mechanism 2 in the right direction and automatically lifts the boom 4 so that the trajectory drawn with a predetermined point on the back surface of the bucket 6 is aligned with the target trajectory. In this embodiment, the end position of the target trajectory is set such that the predetermined point on the back surface of the bucket 6 comes directly above the center point of the range R2. This is because a to-be-loaded object such as the earth and sand is loaded in the order from the inner side of the platform of the dump truck DT (the side close to a front panel or an cab of the dump truck DT) to the front side (the side away from the front panel or the cab of the dump truck DT). However, the end position of the target trajectory may be set by adding a predetermined correction value to the first end position. In this case, the correction value may be set in advance. For example, the correction value may be set to a value corresponding to the bucket size. This is because the earth and sand or the like in the bucket 6 can be caused to be discharged to the range R2 at the completion time point of the second boom up pivot operation only through the operator's bucket opening operation. In this case, the end position of the target trajectory may be calculated based on at least one of the information regarding the bucket 6 such as the volume of the bucket 6 and the information regarding the dump truck DT. However, the end position of the target trajectory may be the same as the end position of the trajectory of the first manually operated boom up pivot operation. In other words, the end position of the target trajectory may be the position of a predetermined point on the back surface of the bucket 6 when the recording switch NS1 is pushed at the second time point.

After completion of the second boom up pivot operation, the operator performs the second earth removal operation in a manual operation. In this embodiment, the operator can discharge the earth and sand or the like in the bucket 6 to the range R2 by only performing a bucket opening operation.

After performing the second earth removal operation, the operator performs the boom down pivot operation manually to bring the bucket 6 close to the embankment F2 shown in FIG. 10B. Then, the operator performs an excavation operation manually to catch the earth and sand or the like forming the mound F2. Then, the operator pushes the automatic switch NS2 at a time point of completion of the excavation operation, that is, at the fourth time point where the state of the shovel 100 is changed into one shown in a dotted line in FIG. 10C, to start the third boom up pivot operation in the autonomous control.

The controller 30 uses the target trajectory calculated at the second time point to perform the third boom up pivot operation in the autonomous control. Specifically, the controller 30 automatically pivots the pivot mechanism 2 in the right direction and automatically lifts the boom 4 so that the trajectory drawn by a predetermined point on the back surface of the bucket 6 can be aligned with the target trajectory. In this embodiment, the end position of the target trajectory is set such that the predetermined point on the back surface of the bucket 6 comes directly above the center point of the range R3. This is because the earth and sand or the like in the bucket 6 can be caused to be discharged to the range R3 only through the operator's bucket opening operation at the completion time point of the third boom up pivot operation.

After completion of the third boom up pivot operation, the operator performs the third earth removal operation manually. In this embodiment, the operator can discharge the earth and sand or the like in the bucket 6 to the range R3 on the platform of the dump truck DT by only performing the bucket opening operation.

As stated above, the operator of the shovel 100 can perform only the first boom up pivot operation for the single dump truck DT manually to cause the shovel 100 to autonomously perform the second and subsequent boom up pivot operations.

Also, in this embodiment, the controller 30 is configured to change the end position of the target trajectory for each boom up pivot operation in the autonomous control based on the information regarding the dump truck DT. Accordingly, the operator of the shovel 100 can only perform the bucket opening operation whenever the boom up pivot operation is finished in the autonomous control to discharge the earth and sand or the like to an appropriate place of the platform of the dump truck DT.

Figure 11:
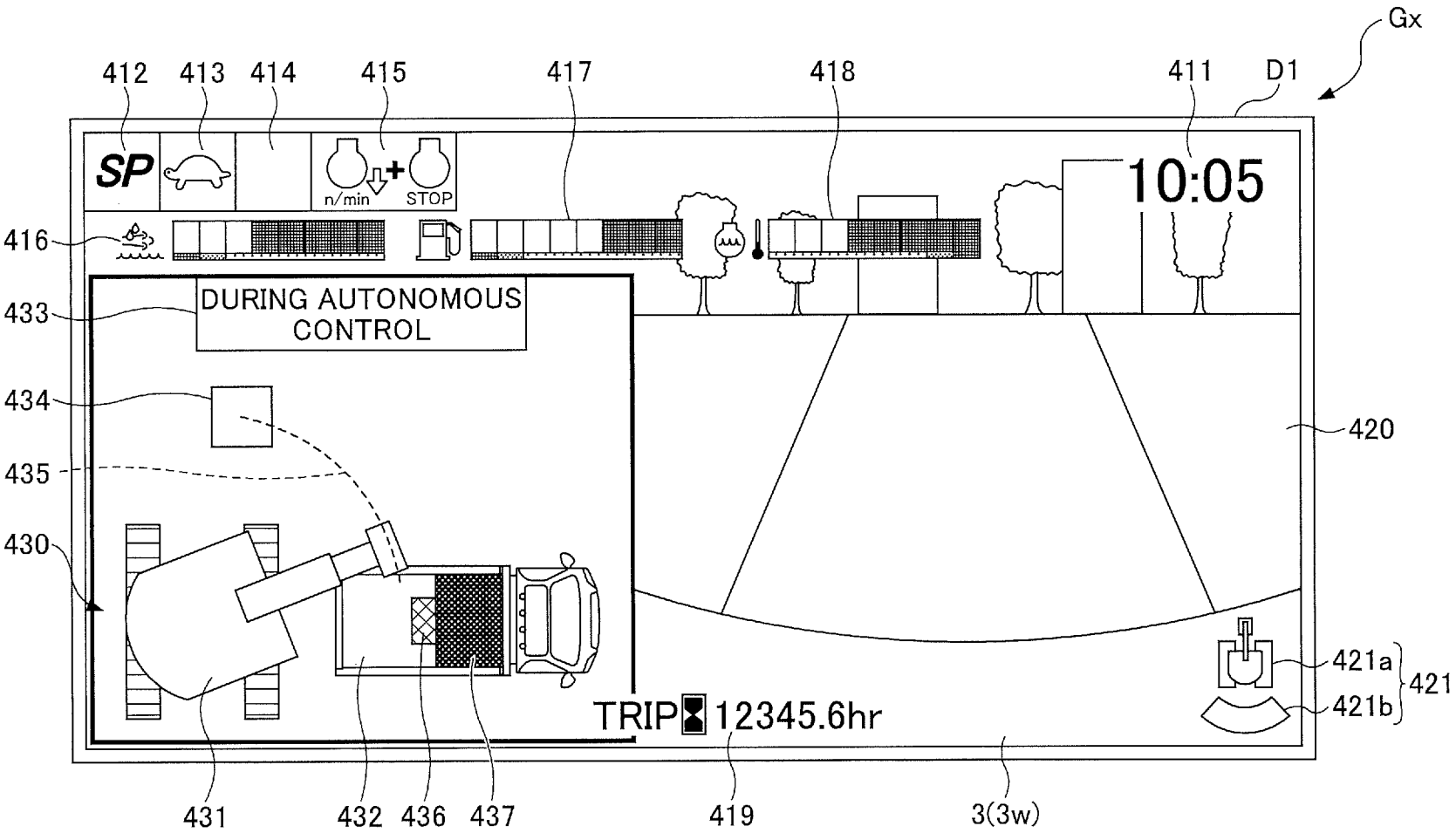
FIG. 11 is a diagram for illustrating an exemplary image displayed in autonomous control.

Next, one exemplary image displayed during execution of the autonomous control is described with reference to FIG. 11. As shown in FIG. 11, the image Gx displayed on the display device D1 includes a time display unit 411, a rotation rate mode display unit 412, a drive mode display unit 413, an attachment display unit 414, an engine control state display unit 415, an urea water remaining amount display unit 416, a fuel remaining amount display unit 417, a cooling water temperature display unit 418, an engine operating time display unit 419, a camera image display unit 420, and a work state display unit 430. The rotation rate mode display unit 412, the drive mode display unit 413, the attachment display unit 414, and the engine control state display unit 415 are display units that display information regarding the setting state of the shovel 100. The urea water remaining amount display unit 416, the fuel remaining amount display unit 417, the cooling water temperature display unit 418, and the engine operating time display unit 419 are display units that display information regarding the operation state of the shovel 100. The images displayed on respective portions are generated by the display device D1 using various types of data transmitted from the controller 30, image data transmitted from the capturing device 80 or the like.

The time display unit 411 displays the current time. The rotation rate mode display unit 412 displays the rotation rate mode set by an engine rotation rate adjustment dial (not shown) as operation information of the shovel 100. The drive mode display unit 413 displays the drive mode as the operation information of the shovel 100. The drive mode indicates the setting condition of the travelling hydraulic motor using a variable capacity motor. For example, the drive mode has a low speed mode and a high speed mode, in the low speed mode, a mark representing a "tortoise" is displayed, and in the high speed mode, a mark representing a "rabbit" is displayed. The attachment display unit 414 is an area for displaying an icon representing the type of the currently mounted attachment. The engine control state display unit 415 displays the control state of the engine 11 as the operation information of the shovel 100. In the example of FIG. 11, the "automatic deceleration and automatic stop mode" is selected as the operation state of the engine 11. The "automatic deceleration and automatic stop mode" means a control state where the engine rotation rate is automatically reduced and the engine 11 is automatically stopped depending on the duration of the non-operation state. Other control states of the engine 11 include "automatic deceleration mode", "automatic stop mode" and "manual deceleration mode".

The urea water remaining amount display unit 416 displays the remaining amount state of urea water stored in an urea water tank as the operation information of the shovel 100. In the example of FIG. 11, the urea water remaining amount display unit 416 displays a bar gauge representing the current remaining amount state of the urea water. The remaining amount of urea water is displayed based on the data fed from an urea water level sensor provided in the urea water tank.

The fuel remaining amount display unit 417 displays the remaining amount of fuel stored in a fuel tank as operation information. In the example of FIG. 11, the fuel remaining amount display unit 417 displays a bar gauge representing the current fuel remaining amount state. The remaining amount of fuel is displayed based on data fed from a fuel remaining amount sensor provided in the fuel tank.

The cooling water temperature display unit 418 displays the temperature condition of the engine cooling water as the operation information of the shovel 100. In the example of FIG. 11, a bar gauge representing the temperature condition of the engine cooling water is displayed in the cooling water temperature display unit 418. The temperature of the engine cooling water is indicated based on data fed from a water temperature sensor provided in engine 11.

The engine operation time display unit 419 displays the accumulated operation time of the engine 11 as the operation information of the shovel 100. In the example of FIG. 11, the engine operation time display unit 419 displays the accumulated operation time since a counter was restarted by the operator along with the unit "hr (time)". The engine operation time display unit 419 may display the lifetime operation time of the entire period after the shovel was manufactured or the interval operation time since the counter was restarted by the operator.

The camera image display unit 420 displays an image captured by the capturing device 80. In the example of FIG. 11, an image taken by a rear camera 80B mounted on a rear end of the top surface of the upper pivot body 3 is displayed on the camera image display unit 420. The camera image display unit 420 may display a camera image captured by a left camera 80L mounted to a left end of the top surface of the upper pivot body 3 or a right camera 80R mounted to a right end of the top surface. The camera image display unit 420 may display images captured by a plurality of cameras of the left camera 80L, the right camera 80R and the rear camera 80B such that the images are in line. Also, the camera image display unit 420 may display a composite image of the plurality of camera images captured by at least two of the left camera 80L, the right camera 80R and the rear camera 80B. For example, the composite image may be a bird's-eye image.

Each camera may be positioned so that a portion of the upper pivot body 3 can be included in the camera image. By including a portion of the upper pivot body 3 in the displayed image, the operator can easily understand the distance between an object displayed on the camera image display unit 420 and the shovel 100. In the example of FIG. 11, the camera image display unit 420 displays an image of a counterweight 3*w* of the upper pivot body 3.

The camera image display unit 420 displays a FIG. 421 representing the direction of the capturing device 80 that has captured the displayed camera image. The FIG. 421 is composed of a shovel FIG. 421*a* representing the shape of the shovel 100 and a band-shaped directional indication shape 421*b* representing the capturing direction of the capturing device 80 that has captured the displayed camera image. The FIG. 421 is a display unit that displays information regarding the setting state of the shovel 100.

In the example of FIG. 11, the directional indication FIG. 421*b* is displayed on the underside of the shovel FIG. 421*a* (in the opposite side to the figure representing the excavation attachment AT). This indicates that a rear image of the shovel 100 captured by the rear camera 80B is displayed on the camera image display unit 420. For example, if an image captured by the right camera 80R is displayed on the camera image display unit 420, the directional indication FIG. 421*b* is displayed on the right side of the shovel FIG. 421*a*. Also, for example, if an image captured by the left camera 80L is displayed on the camera image display unit 420, the directional indication FIG. 421*b* is displayed on the left side of the shovel FIG. 421*a*.

For example, the operator can push an image selector switch (not shown) provided in the cabin 10 to switch the image displayed on the camera image display unit 420 to an image or the like captured by another camera.

If the shovel 100 is not provided with the capturing device 80, different information may be displayed instead of the camera image display unit 420.

The work state display unit 430 displays the work state of the shovel 100. In the example of FIG. 11, the work state display unit 430 includes a FIG. 431 of the shovel 100, a FIG. 432 of the dump truck DT, a FIG. 433 representing the state of the shovel 100, a FIG. 434 representing the completion position of the excavation, a FIG. 435 representing the target trajectory, a figure representing the start of the earth removal, a FIG. 436 representing the start position of the earth removal, and a FIG. 437 of the earth and sand already loaded on the platform of the dump truck DT. The FIG. 431 shows the state of shovel 100 when the shovel 100 is viewed from the top. The FIG. 432 shows the state of the dump truck DT when the dump truck DT is viewed from above. The FIG. 433 is a text message representing the state of the shovel 100. The FIG. 434 shows the state of the bucket 6 after completion of the excavation operation when the bucket 6 is viewed from the top. The FIG. 435 shows the top view of the target trajectory. The FIG. 436 shows the state of the bucket 6 when the earth removal operation is started, that is, when the bucket 6 at the end position of the target trajectory is viewed. The FIG. 437 shows the state of earth and sand already loaded onto the platform of the dump truck DT.

The controller 30 may be configured to generate the FIGS. 431 to 436 based on the information regarding the posture of the shovel 100 and the information regarding the dump truck DT and the like. Specifically, the FIG. 431 may be generated to represent the actual posture of the shovel 100, and the FIG. 432 may be generated to represent the actual orientation and size of the dump truck DT. Also, the FIG. 434 may be generated based on the information recorded by the posture recording unit 30A, and the FIGS. 435 and 436 may be generated based on the information calculated by the trajectory calculation unit 30B. Also, the controller 30 may detect the state of earth and sand already loaded onto the platform of the dump truck DT based on the output of at least one of the object detection device 70 and the capturing device 80 and change the position and size of the FIG. 437 depending on the detected state.

The controller 30 may also display the current number of boom up pivot operations of the dump truck DT, the number of boom up pivot operations by the autonomous control, the weight of the earth and sand loaded on the dump truck DT, and the ratio of the weight of the earth and sand loaded on the dump truck DT to the maximum load weight on the work state display unit 430.

According to this arrangement, the operator of the shovel 100 can view the image Gx to determine whether the autonomous control is performed. Also, by viewing the image Gx including the FIG. 431 of the shovel 100 and the FIG. 432 of the dump truck DT, the operator can easily grasp the relative positional relationship of the shovel 100 and the dump truck DT. In addition, by viewing the image Gx including the FIG. 435 representing the target trajectory, the operator can easily understand the set target trajectory. In addition, by viewing the image Gx including the FIG. 434, which is information regarding the excavation completion position serving as the start position of the boom up pivot operation, the operator can easily grasp the state when the boom up pivot operation is started. In addition, by viewing the image Gx including the FIG. 436, which is information regarding the earth removal start position that is the completion position of the boom up pivot operation, the operator can easily grasp the state when the boom up pivot operation is finished.

As stated above, the shovel 100 according to an embodiment of the present invention includes a lower travelling body 1, an upper pivot body 3 pivotably mounted to the lower travelling body 1, an excavation attachment AT as an attachment rotatably mounted to the upper pivot body 3, and the controller 30 serving as a control device provided to the upper pivot body 3. The controller 30 is configured to autonomously perform a compound operation including operations of excavation attachment AT and the pivot operation. According to this arrangement, the shovel 100 can autonomously perform the compound operation including the pivot operation in accordance with the operator's intention.

The compound operation including the pivot operation may be a boom up pivot operation, for example. The target trajectory for the boom up pivot operation is calculated based on the information recorded during the manually operated boom up pivot operation, for example. However, the target trajectory for the boom up pivot operation may be calculated based on the information recorded during the manually operated boom down pivot operation. Also, the compound operation including the pivot operation may be a boom down pivot operation. The target trajectory for the boom down pivot operation is calculated based on the information recorded during the manually operated boom down pivot operation, for example. However, the target trajectory for the boom down pivot operation may be calculated based on the information recorded during the manually operated boom up pivot operation. The compound operation including the pivot operation may also be another repetitive operation including the pivot operation.

The shovel 100 may include a posture detection device for obtaining information regarding the orientation of the excavation attachment AT. The posture detection device may include, for example, at least one of a boom angle sensor S1, an arm angle sensor S2, a bucket angle sensor S3, a body tilt sensor S4, and a pivot angular velocity sensor S5. The controller 30 may be configured to calculate a target trajectory drawn by a predetermined point in the excavation attachment AT based on the information acquired by the posture detection device and perform a compound operation autonomously so that a predetermined point moves along the target trajectory. The predetermined point in the excavation attachment AT may be, for example, a predetermined point on the back surface of the bucket 6.

The controller 30 is configured to perform the compound operation repeatedly and may be configured to change the target trajectory each time the compound operation is performed. Namely, the target trajectory for the repeated compound operation such as a boom up pivot operation may be updated for each execution of the compound operation. For example, the controller 30 may change the end position of the target trajectory (for example, the start position of the earth removal) for each execution of the autonomously controlled boom up pivot operation as stated with reference to FIGS. 10A to 10C. Also, the controller 30 may change the start position (for example, the excavation completion position) of the target trajectory for each execution of the autonomously controlled boom up pivot operation. Namely, at least one of the start position and the end position of the target trajectory may be updated for each execution of the boom up pivot operation.

The shovel 100 may have the recording switch NS1 as a second switch provided in the cabin 10. Then, the controller 30 may be configured to acquire the information regarding the posture of the excavation attachment AT when the recording switch NS1 is operated.

The controller 30 may be configured to perform the compound operation autonomously during operation of the automatic switch NS2 as the first switch or during execution of the pivot operation in the state where the automatic switch NS2 is being operated. Then, even if the automatic switch NS2 is not provided, the controller 30 may be configured to autonomously perform the compound operation including the pivot operation on condition that the pivot operation has been performed after recording the information regarding the posture of the shovel 100.

The preferred embodiments of the present invention have been described in detail above. However, the present invention is not limited to the embodiments described above. Various modifications, substitutions and the like may be applied to the embodiments described above without departing from the scope of the present invention. Also, the features described separately may be combined unless there is a technical inconsistency.

Figure 12:
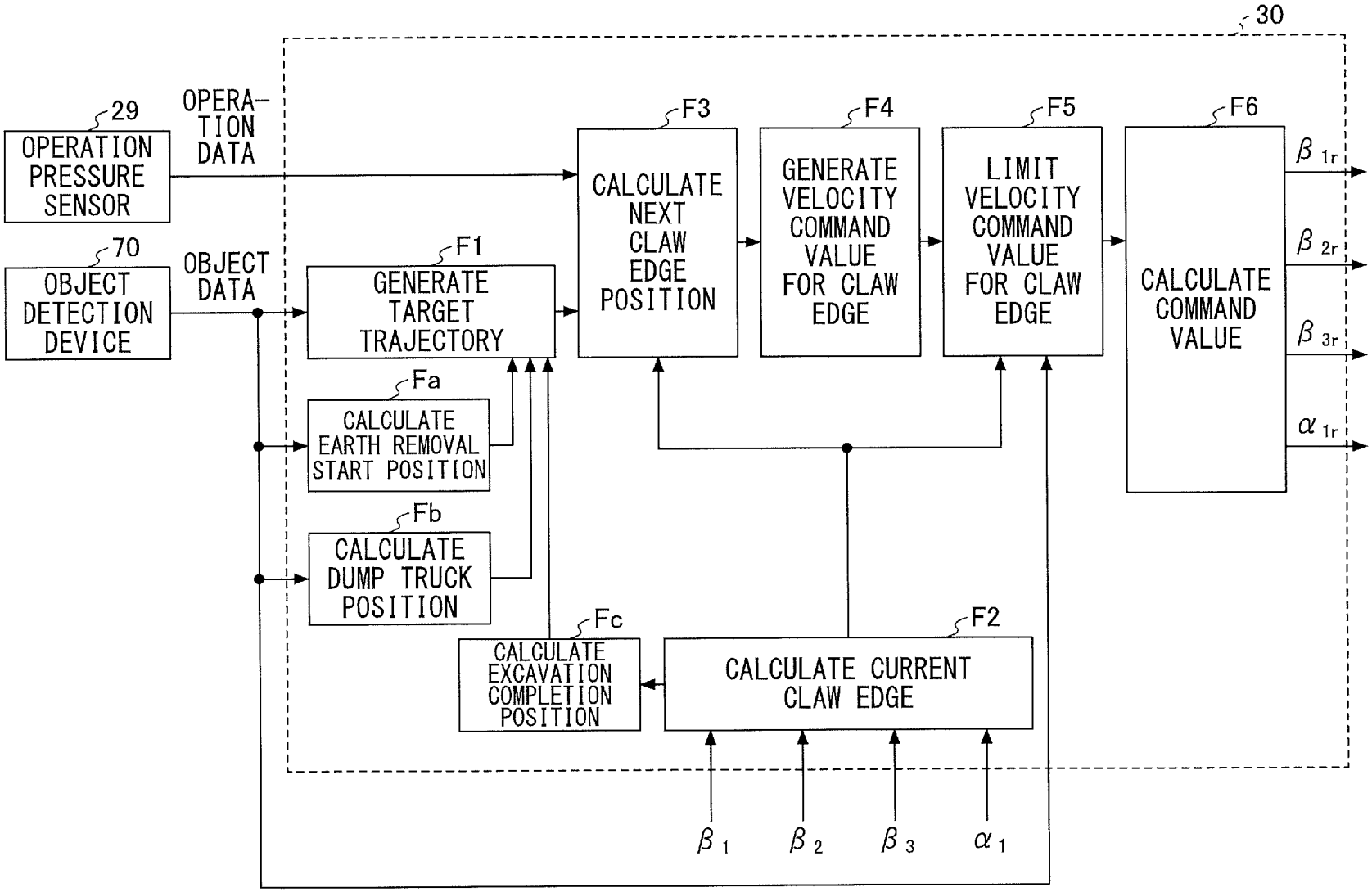
FIG. 12 is a block diagram for illustrating another exemplary arrangement of an autonomous control function.

For example, the shovel 100 may perform the autonomous control function as described below to perform the compound operation autonomously. FIG. 12 is a block diagram for illustrating another exemplary arrangement of the autonomous control function. In the example of FIG. 12, controller 30 includes functional elements Fa to Fc and F1 to F6 related to execution of the autonomous control. The functional elements may be composed of software, hardware, or a combination of software and hardware.

The functional element Fa is configured to calculate the earth removal start position. In this embodiment, before the earth removal operation is actually started, the functional element Fa calculates the position of the bucket 6 at starting the earth removal operation as the earth removal start position based on object data fed from the object detection device 70. Specifically, the functional element Fa detects the state of earth and sand already loaded on the platform of the dump truck DT based on the object data fed from the object detection device 70. The state of the earth and sand may be related to where the earth and sand is loaded onto the platform of the dump truck DT, for example. Then, the functional element Fa calculates the earth removal start position based on the detected state of the earth and sand. However, the functional element Fa may calculate the earth removal start position based on the output of the capturing device 80. Alternatively, the functional element Fa may calculate the earth removal start position based on the posture of the shovel 100 recorded by the posture recording unit 30A in the previous earth removal operation. Alternatively, the functional element Fa may calculate the earth removal start position based on the output of the posture detection device. In this case, for example, before the earth removal operation is actually started, the functional element Fa may calculate the position of the bucket 6 at the start time of the earth removal operation as the earth removal start position based on the current posture of the excavation attachment.

The functional element Fb is configured to calculate a dump truck position. In this embodiment, the functional element Fb calculates the respective positions of portions constituting the loading platform of the dump truck DT as the dump truck positions based on object data fed from the object detection device 70.

The functional element Fc is configured to calculate the excavation completion position. In this embodiment, the functional element Fc calculates the position of the bucket 6 at completion of the excavation operation as the excavation completion position based on the position of the claw edge of the bucket 6. Specifically, the functional element Fc calculates the excavation completion position based on the current position of the claw edge of the bucket 6 that is calculated by the functional element F2 as described below.

The functional element F1 is configured to generate a target trajectory. In this embodiment, the functional element F1 generates the target trajectory of the claw edge of the bucket 6 based on object data fed from the object detection device 70 and the excavation completion position calculated by the functional element Fc. The object data may be information regarding an object existing around the shovel 100 such as the position and shape of the dump truck DT, for example. Specifically, the functional element F1 calculates the target trajectory based on the earth removal start position calculated by the functional element Fa, the dump truck position calculated by the functional element Fb, and the excavation completion position calculated by the functional element Fc.

The functional element F2 is configured to calculate the current position of the claw edge. In this embodiment, the functional element F2 calculates the coordinate point of the claw edge of the bucket 6 as the current claw edge position based on the boom angle $\beta_1$ detected by the boom angle sensor S1, the arm angle $\beta_2$ detected by the arm angle sensor S2, the bucket angle $\beta_3$ detected by the bucket angle sensor S3, and the pivot angle $\alpha_1$ detected by the pivot angular velocity sensor S5. The functional element F2 may use an output of the body tilt sensor S4 to calculate the current claw edge position.

The functional element F3 is configured to calculate the next claw edge position. In this embodiment, the functional element F3 calculates the claw edge position after a predetermined time as a target claw edge position based on operation data fed from the operation pressure sensor 29, the target trajectory generated by the functional element F1, and the current claw edge position calculated by the functional element F2.

The functional element F3 may determine whether the deviation between the current claw edge position and the target trajectory is within an acceptable range. In this embodiment, the functional element F3 determines whether the distance between the current claw edge position and the target trajectory is less than or equal to a predetermined value. If the distance is less than or equal to the predetermined value, the functional element F3 determines that the deviation is within the acceptable range and calculates the target claw edge position. On the other hand, if the distance exceeds the predetermined value, the functional element F3 determines that the deviation is not within the acceptable range and decelerates or stops the movement of an actuator regardless of the lever operation amount. According to this arrangement, the controller 30 can prevent the autonomous control from being continuously performed in the state where the claw edge position deviates from the target trajectory.

The functional element F4 is configured to generate a command value for the velocity of the claw edge. In this embodiment, the functional element F4 calculates the velocity of the claw edge required to move the current claw edge position to the next claw edge position within a predetermined time as a command value for the claw edge velocity based on the current claw edge position calculated by the functional element F2 and the next claw edge position calculated by the functional element F3.

The functional element F5 is configured to limit the command value for the claw edge velocity. In this embodiment, if it is determined based on the current claw edge position calculated by the functional element F2 and an output of the object detection device 70 that the distance between the claw edge and the dump truck DT is less than a predetermined value, the functional element F5 limits the command value for the claw edge velocity to a predetermined upper limit value. In this manner, when the claw edge approaches the dump truck DT, the controller 30 slows down the claw edge velocity.

The functional element F6 is configured to calculate a command value for operating an actuator. In this embodiment, the functional element F6 calculates a command value $\beta_{1r}$ for the boom angle $\beta_1$, a command value $\beta_{2r}$ for the arm angle $\beta_2$, a command value $\beta_{3r}$ for the bucket angle $\beta_3$, and a command value $\alpha_{1r}$ for the pivot angle $\alpha_1$ based on a target claw edge position calculated by the functional element F3 in order to move the current claw edge position to the target claw edge position. Even when the boom 4 is not operated, the functional element F6 calculates the command value $\beta_{1r}$ as necessary. This is to automatically operate the boom 4. The same applies to the arm 5, the bucket 6 and the pivot mechanism 2.

Figure 13:
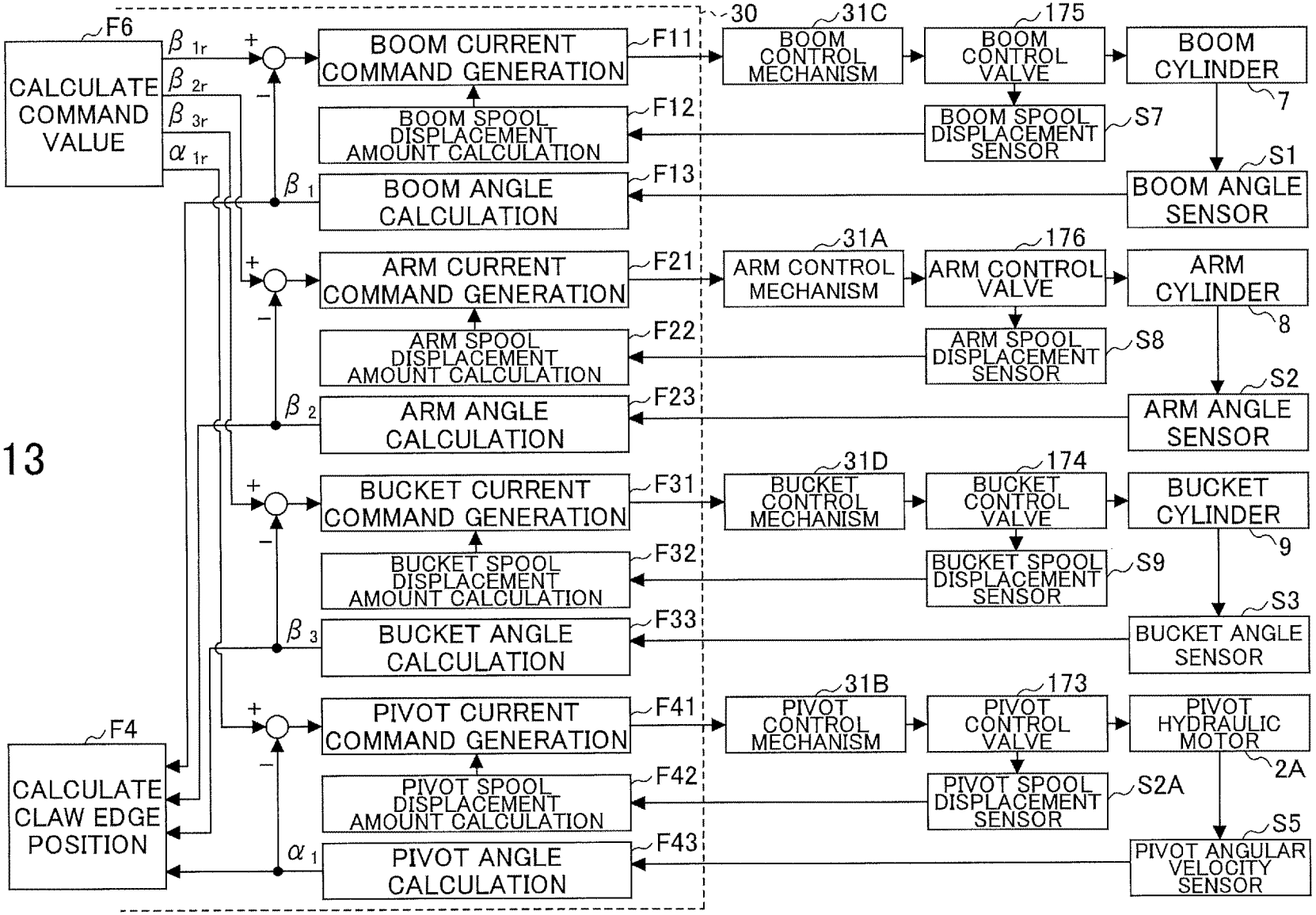
FIG. 13 is a block diagram for illustrating another exemplary arrangement of an autonomous control function.

Next, the functional element F6 is described in detail with reference to FIG. 13. FIG. 13 is a block diagram for illustrating an exemplary arrangement of the functional element F6 that calculates various command values.

The controller 30 further includes functional elements F11 to F13, F21 to F23, and F31 to F33 related to generation of the command values, as shown in FIG. 13. The functional elements may consist of software, hardware, or a combination of software and hardware.

The functional elements F11 to F13 are functional elements for the command value $\beta_{1r}$, the functional elements F21 to F23 are functional elements for the command value $\beta_{2r}$, the functional elements F31 to F33 are functional elements for the command value $\beta_{3r}$, and the functional elements F41 to F43 are functional elements for the command value $\alpha_{1r}$.

The functional elements F11, F21, F31, and F41 are configured to generate a current command fed to the proportional valve 31. In this embodiment, the functional element F11 outputs a boom current command to the boom control mechanism 31C, the functional element F21 outputs an arm current command to the arm control mechanism 31A, the functional element F31 outputs a bucket current command to the bucket control mechanism 31D, and the functional element F41 outputs a pivot current command to the pivot control mechanism 31B.

The bucket control mechanism 31D is configured to cause the pilot pressure corresponding to the control current corresponding to a bucket cylinder pilot pressure command to be applied to the control valve 174 serving as a bucket control valve. The bucket control mechanism 31D may be, for example, the proportional valve 31DL and the proportional valve 31DR in FIG. 3D.

The functional elements F12, F22, F32, and F42 are configured to calculate the displacement amount of a spool constituting a spool valve. In this embodiment, the functional element F12 calculates the displacement amount of a boom spool constituting the control valve 175 with respect to the boom cylinder 7 based on an output of a boom spool displacement sensor S7. The functional element F22 calculates the displacement amount of an arm spool constituting the control valve 176 with respect to an arm cylinder 8 based on an output of an arm spool displacement sensor S8. The functional element F32 calculates the displacement amount of a bucket spool constituting the control valve 174 with respect to a bucket cylinder 9 based on an output of a bucket spool displacement sensor S9. The functional element F42 calculates the displacement amount of a swivel spool constituting the control valve 173 with respect to a pivot hydraulic motor 2A based on an output of a pivot spool displacement sensor S2A. Note that the bucket spool displacement sensor S9 is a sensor for detecting the displacement amount of the spool constituting the control valve 174.

The functional elements F13, F23, F33, and F43 are configured to calculate the rotational angle of a workpiece. In this embodiment, the functional element F13 calculates the boom angle $\beta_1$ based on an output of the boom angle sensor S1. The functional element F23 calculates the arm angle $\beta_2$ based on an output of the arm angle sensor S2. The functional element F33 calculates the bucket angle $\beta_3$ based on an output of the bucket angle sensor S3. The functional element F43 calculates the pivot angle $\alpha_1$ based on an output of the pivot angular velocity sensor S5.

Specifically, the functional element F11 basically generates a boom current command to the boom control mechanism 31C such that the difference between the command value $\beta_{1r}$ generated by the functional element F6 and the boom angle $\beta_1$ calculated by the functional element F13 becomes zero. At that time, the function element F11 adjusts the boom current command so that the difference between the target boom spool displacement amount derived from the boom current command and the boom spool displacement amount calculated by the function element F12 becomes zero. Then, the functional element F11 outputs the adjusted boom current command to the boom control mechanism 31C.

The boom control mechanism 31C changes the opening area in response to the boom current command to apply the pilot pressure corresponding to the size of the opening area to a pilot port of the control valve 175. The control valve 175 moves a boom spool corresponding to the pilot pressure to cause the hydraulic oil to flow into the boom cylinder 7. The boom spool displacement sensor S7 detects the displacement of the boom spool and feeds back the detection result to the functional element F12 of the controller 30. The boom cylinder 7 extends or contracts in response to the inflow of the hydraulic oil to move the boom 4 up or down. The boom angle sensor S1 detects the rotation angle of the vertically moving boom 4 and feeds back the detection result to the functional element F13 of the controller 30. The functional element F13 feeds back the calculated boom angle $\beta_1$ to the functional element F4.

The functional element F21 basically generates an arm current command for the arm control mechanism 31A such that the difference between the command value $\beta_{2r}$ generated by the functional element F6 and the arm angle $\beta_2$ calculated by the functional element F23 becomes zero. At that time, the functional element F21 adjusts the arm current command so that the difference between a target arm spool displacement amount derived from the arm current command and the arm spool displacement amount calculated by the functional element F22 becomes zero. Then, the functional element F21 feeds the adjusted arm current command to the arm control mechanism 31A.

The arm control mechanism 31A changes the opening area in response to an arm current command to apply the pilot pressure corresponding to the size of the opening area to a pilot port of the control valve 176. The control valve 176 moves the arm spool in response to the pilot pressure to cause the hydraulic oil to flow into the arm cylinder 8. The arm spool displacement sensor S8 detects the displacement of the arm spool and feeds back the detection result to the functional element F22 of the controller 30. The arm cylinder 8 expands and contracts in response to the inflow of the hydraulic oil to open and close the arm 5. The arm angle sensor S2 detects the rotation angle of the opening and closing arm 5 and feeds back the detection result to the functional element F23 of the controller 30. The functional element F23 feeds back the calculated arm angle $\beta_2$ to the functional element F4.

The functional element F31 basically generates a bucket current command to the bucket control mechanism 31D such that the difference between the command value $\beta_{3r}$ generated by functional element F6 and the bucket angle $\beta_3$ calculated by functional element F33 becomes zero. At that time, the functional element F31 adjusts the bucket current command so that the difference between a target bucket spool displacement amount derived from the bucket current command and the bucket spool displacement amount calculated by the functional element F32 becomes zero. Then, the functional element F31 feeds the adjusted bucket current command to the bucket control mechanism 31D.

The bucket control mechanism 31D changes the opening area in response to a bucket current command to apply the pilot pressure corresponding to the size of the opening area to a pilot port of the control valve 174. The control valve 174 moves a bucket spool in response to the pilot pressure to cause the hydraulic oil to flow into the bucket cylinder 9. The bucket spool displacement sensor S9 detects the displacement of the bucket spool and feeds back the detection result to the functional element F32 of the controller 30. The bucket cylinder 9 extends and contracts in response to the inflow of the hydraulic oil to open and close the bucket 6. The bucket angle sensor S3 detects the rotation angle of the opening and closing bucket 6 and feeds back the detection result to the functional element F33 of the controller 30. The functional element F33 feeds back the calculated bucket angle $\beta_3$ to the functional element F4.

The functional element F41 basically generates a pivot current command for the pivot control mechanism 31B such that the difference between the command value $\alpha_{1r}$ generated by the functional element F6 and the pivot angle $\alpha_1$ calculated by the functional element F43 becomes zero. At this time, the function element F41 adjusts the pivot current command so that the difference between a target pivot spool displacement amount derived from the pivot current command and the pivot spool displacement amount calculated by the function element F42 becomes zero. Then, the functional element F41 feeds the adjusted pivot current command to the pivot control mechanism 31B.

The pivot control mechanism 31B changes the opening area in response to the pivot current command to apply the pilot pressure corresponding to the size of the opening area to a pilot port of the control valve 173. The control valve 173 moves the pivot spool in response to the pilot pressure to cause the hydraulic oil to flow into the pivot hydraulic motor 2A. The pivot spool displacement sensor S2A detects the displacement of the pivot spool and feeds back the detection result to the functional element F42 of the controller 30. The pivot hydraulic motor 2A rotates corresponding to the inflow of the hydraulic oil to pivot the upper pivot body 3. The pivot angular velocity sensor S5 detects the pivot angle of the upper pivot body 3 and feeds back the detection result to the functional element F43 of the controller 30. The function element F43 feeds back the calculated pivot angle $\alpha_1$ to the function element F4.

As stated above, the controller 30 forms a three-stage feedback loop for each workpiece. Namely, the controller 30 constitutes a feedback loop for the spool displacement amount, a feedback loop for the pivot angle of the workpiece, and a feedback loop for the claw edge position. Therefore, the controller 30 can precisely control the movement of the claw edge of the bucket 6 in the autonomous control.

Also, in the embodiments stated above, a hydraulic control lever including a hydraulic pilot circuit is disclosed. Specifically, in the hydraulic pilot circuit for the left control lever 26L functioning as an arm control lever, the hydraulic oil supplied from the pilot pump 15 to a remote control valve of the left control lever 26L is transmitted to a pilot port of the control valve 176 serving as an arm control valve at a flow rate corresponding to the opening of the remote control valve that is opened and closed by tilting of the left control lever 26L.

Instead of the hydraulic operation lever including such a hydraulic pilot circuit, however, an electric operation lever including an electric pilot circuit may be employed. In this case, the lever operation amount of the electric operation lever is fed to the controller 30 as an electric signal. Also, a solenoid valve is also disposed between the pilot pump 15 and a pilot port of each control valve. The solenoid valve is configured to operate in response to an electrical signal from the controller 30. According to this arrangement, if a manual operation is performed by means of the electric operation lever, the controller 30 can control the solenoid valves by means of the electric signal corresponding to the lever operation amount to increase or decrease the pilot pressure and move the respective control valve within the control valve 17. Note that each control valve may be composed of a solenoid spool valve. In this case, the solenoid spool valve operates in response to an electric signal from the controller 30 corresponding to the lever operation amount of the electric control lever.

Figure 14:
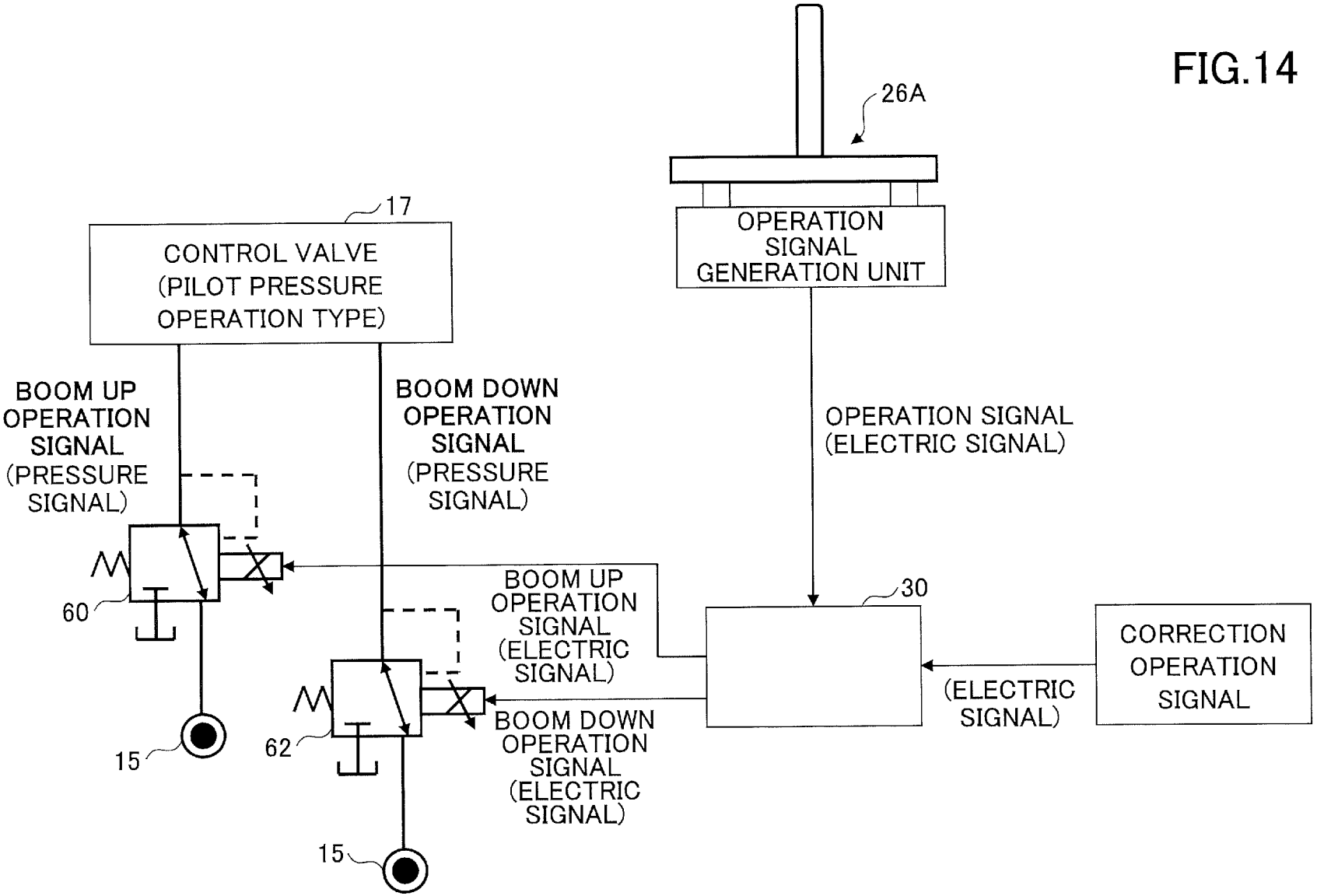
FIG. 14 is a diagram for illustrating an exemplary arrangement of an electric operation system.

If an electric operation system with an electric control lever is employed, the controller 30 can perform an autonomous control function more easily than a hydraulic operation system with a hydraulic operation lever. FIG. 14 shows an exemplary arrangement of an electric operation system. Specifically, the electric operation system of FIG. 14 is one example of a boom operation system, which is mainly composed of a pilot pressure operation type of control valve 17, a boom operation lever 26A as an electric operation lever, a controller 30, a solenoid valve 60 for the boom up operation, and a solenoid valve 62 for the boom down operation. The electric operation system of FIG. 14 may also be analogously applied to an arm operation system, a bucket operation system, and the like.

A pilot pressure actuation type of control valve 17 includes a control valve 175 (see FIG. 2) for the boom cylinder 7, a control valve 176 (see FIG. 2) for the arm cylinder 8, and a control valve 174 (see FIG. 2) for the bucket cylinder 9. The solenoid valve 60 is configured to adjust the flow path area of a conduit that couples the pilot pump 15 to the upside pilot port of the control valve 175. The solenoid valve 62 is configured to adjust the flow path area of a conduit that couples the pilot pump 15 to the downside pilot port of the control valve 175.

If a manual operation is performed, the controller 30 generates a boom up operation signal (electric signal) or a boom down operation signal (electric signal) in response to an operation signal (electric signal) fed from an operation signal generation unit of the boom operation lever 26A. The operation signal fed from the operation signal generation unit of the boom operation lever 26A is an electric signal that varies depending on the operation amount and the operation direction of the boom operation lever 26A.

Specifically, if the boom operation lever 26A is operated in the boom up direction, the controller 30 outputs a boom up operation signal (electric signal) corresponding to the lever operation amount to the solenoid valve 60. The solenoid valve 60 adjusts the flow path area in response to the boom up operation signal (electric signal) and controls the pilot pressure serving as a boom up operation signal (pressure signal) applied to the upside pilot port of the control valve 175. Similarly, if the boom operation lever 26A is operated in the boom down direction, the controller 30 outputs a boom down operation signal (electric signal) corresponding to the lever operation amount to the solenoid valve 62. The solenoid valve 62 adjusts the flow path area in response to the boom down operation signal (electric signal) and controls the pilot pressure serving as a boom down operation signal (pressure signal) applied to the downside pilot port of the control valve 175.

If the autonomous control is performed, the controller 30 generates a boom up operation signal (electric signal) or a boom down operation signal (electric signal) in accordance with a correction operation signal (electric signal) instead of an operation signal (electric signal) fed from the operation signal generation unit of the boom operation lever 26A. The correction operation signal may be an electric signal generated by the controller 30 or an electric signal generated by an external controller other than the controller 30.

Figure 15:
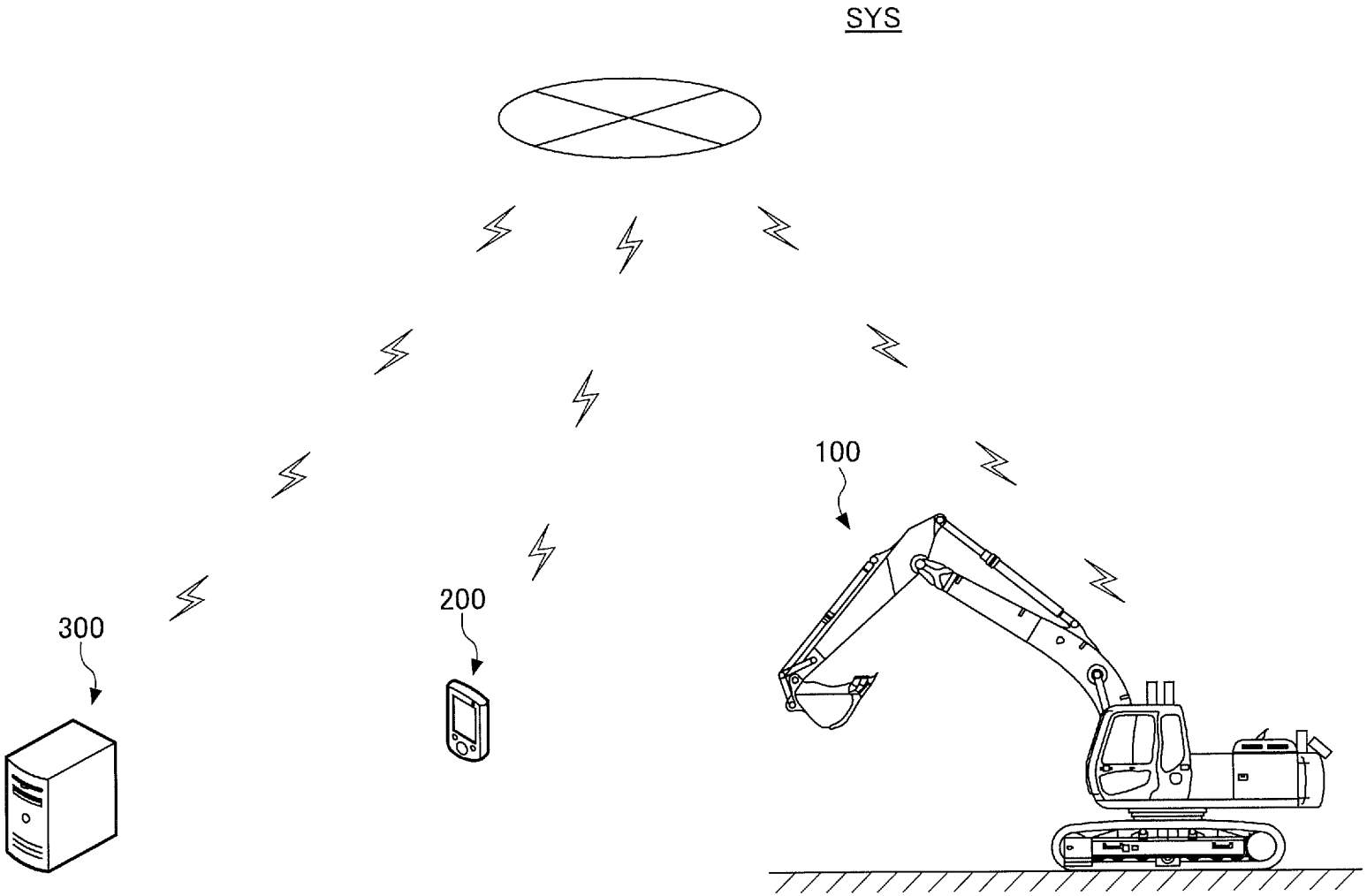
FIG. 15 is a schematic diagram for illustrating an exemplary arrangement of a shovel management system.

The information obtained by the shovel 100 may be shared with an administrator and other operators of the shovel through a shovel management system SYS as shown in FIG. 15. FIG. 15 is a schematic diagram for illustrating an exemplary arrangement of the shovel management system SYS. The management system SYS is a system that manages one or more shovels 100. In this embodiment, the management system SYS is mainly composed of the shovel 100, an assistance device 200, and a management device 300. Each of the shovel 100, the assistance device 200, and the management device 300 in the management system SYS may be a single unit or multiple units. In the example of FIG. 15, the management system SYS includes one shovel 100, one assistance device 200, and one management device 300.

The assistance device 200 is typically a portable terminal device, such as a notebook PC, a tablet PC or a smartphone carried by a worker or the like at a construction site. The assistance device 200 may be a computer carried by an operator of shovel 100. The assistance device 200 may be a fixed terminal device.

The management device 300 is typically a fixed terminal device, such as a server computer installed in a management center or the like outside a construction site. The management device 300 may be a portable computer (for example, a portable terminal device such as a notebook PC, a tablet PC or a smartphone).

At least one of the assistance device 200 and the management device 300 may have a monitor and a remote operation device. In this case, the operator may operate the shovel 100 using the remote operation device. The remote operation device may be connected to the controller 30 through a communication network such as a wireless communication network. Hereinafter, exchanges of information between the shovel 100 and the management apparatus 300 are described, but the following description applies similarly to exchanges of information between the shovel 100 and the assistance apparatus 200.

In the above-stated management system SYS of the shovel 100, the controller 30 of the shovel 100 may transmit information to the management apparatus 300 regarding at least one of the time and location where the autonomous control is started or stopped, the target trajectory used in the autonomous control, and the trajectory actually traced by a predetermined portion during the autonomous control. At this time, the controller 30 may transmit at least one of an output of the object detection device 70 and an image or the like captured by the capturing device 80 to the management device 300. The image may be a plurality of images captured during a predetermined period including the period during which the autonomous control has been performed. Additionally, the controller 30 may transmit information regarding at least one of the following to the management device 300: data about work contents of the shovel 100 during a predetermined period of time including the period during which the autonomous control has been performed, data about the posture of the shovel 100, and data about the posture of an excavation attachment. This is to make the information regarding the worksite available to the administrator using the management device 300. The data regarding work contents of the shovel 100 is at least one of the number of loading times that is the number of times the earth removal has been performed, information regarding a to-be-loaded object such as earth and sand loaded on the platform of the dump truck DT, the type of the dump truck DT for the loading operation, information regarding the position of the shovel 100 in the loading operation, information regarding the working environment, and information regarding the operation of the shovel 100 in the loading operation. The information regarding the to-be-loaded object is at least one of the weight and type of the loaded object in each earth removal operation, the weight and type of the loaded object in each dump truck DT, and the weight and type of the loaded object in each day loading operation. The information regarding the working environment may be, for example, information regarding the slope of the ground around the shovel 100 or information regarding the weather around the work site. The information regarding the operation of the shovel 100 is at least one of a pilot pressure and a hydraulic oil pressure in a hydraulic actuator, for example.

In this manner, the management system SYS of the shovel 100 according to embodiments of the present invention allows the information regarding the shovel 100 acquired during a predetermined period, including the period during which the autonomous control by the shovel 100 is performed, to be shared with the administrator and other operators of the shovel.

What is claimed is:

1. A shovel comprising:

a lower travelling body;

an upper pivot body pivotably mounted to the lower travelling body;

an attachment attached to the upper pivot body, the attachment including a bucket;

a display; and a controller provided to the upper pivot body, wherein the controller is configured to autonomously perform a compound operation including an operation of the attachment and a pivot operation, the compound operation is a boom up pivot operation for loading a to-be-loaded object onto a platform of a dump truck, the controller is configured to autonomously perform the boom up pivot operation such that the to-be-loaded object is loaded onto the platform at a plurality of positions above the platform in an order from an inner side to a front side of the platform, and the controller is configured to display, on a same screen on the display, a first figure of the shovel, a second figure representing an excavation completion position that is a start position of the boom up pivot operation, a third figure representing a target trajectory drawn by a predetermined point on the bucket, a fourth figure representing a dump start position that is a completion position of the boom up pivot operation, a fifth figure showing a state of the to-be-loaded object loaded on the platform of the dump truck, and a sixth figure of the dump truck, the second figure showing a state of the bucket as viewed from above when excavation is completed, the third figure showing the target trajectory as viewed from above, the third figure starting at the second figure and ending at the fourth figure, the fourth figure showing a state of the bucket as viewed from above when dumping is started, the fourth figure and the fifth figure being displayed over the sixth figure.

2. The shovel as claimed in claim 1, further comprising:

one or more operation levers provided in a cabin mounted to the upper pivot body, wherein the controller is configured to perform the compound operation for one of the one or more operation levers.

3. The shovel as claimed in claim 1, wherein the controller is configured to, in response to a first switch provided in a cabin mounted to the upper pivot body being operated, autonomously perform the compound operation.

4. The shovel as claimed in claim 1, further comprising:

a posture sensor configured to obtain information regarding a posture of the attachment, wherein the controller is configured to calculate the target trajectory based on the information obtained by the posture sensor and autonomously perform the compound operation so that the predetermined point moves along the target trajectory.

5. The shovel as claimed in claim 4, wherein the controller is configured to perform the compound operation repeatedly and is configured to change the target trajectory for each execution of the compound operation.

6. The shovel as claimed in claim 4, further comprising:

a second switch provided in a cabin mounted to the upper pivot body, wherein the controller is configured to, in response to the second switch being operated, obtain the information regarding the posture of the attachment.

7. The shovel as claimed in claim 4, wherein the controller is configured to determine whether a deviation between the predetermined point and the target trajectory is within an allowable range.

8. The shovel as claimed in claim 1, wherein the controller is configured to autonomously perform the compound operation during an operation of a first switch provided in a cabin mounted to the upper pivot body or during the pivot operation in a state where the first switch is operated.

9. The shovel as claimed in claim 1, wherein the controller is configured to display a relative positional relationship between the shovel and the dump truck on the display.

10. The shovel as claimed in claim 1, wherein the controller is configured to limit velocity of a work portion with a predetermined upper limit value in response to determining that a distance between the predetermined point and the dump truck is less than a predetermined value.

11. The shovel as claimed in claim 1, wherein the controller is configured to decrease velocity of a work portion in response to determining that a distance between the predetermined point and the dump truck is less than a predetermined value.

12. The shovel as claimed in claim 1, wherein the controller is configured to compose a feedback loop for a position of the predetermined point with respect to the target trajectory, and to compose a feedback loop regarding a rotation angle of the upper pivot body based on a detected value of the rotation angle of the upper pivot body.

13. The shovel as claimed in claim 1, wherein the controller is configured to set another target trajectory drawn by the predetermined point in a boom down pivot operation.

14. The shovel as claimed in claim 1, further comprising:

a sensor configured to detect an object existing around the shovel; and a camera configured to capture an image of a periphery of the shovel, wherein the controller is configured to detect the state of the to-be-loaded object loaded on the platform of the dump truck based on an output of at least one of the sensor or the camera, and change a position and size of the fifth figure showing the state of the to-be-loaded object according to the detected state.

15. The shovel as claimed in claim 1, wherein the controller is further configured to display a seventh figure representing a state of the shovel on the display, the seventh figure being a text message indicating that autonomous control of the shovel is in progress.

16. The shovel as claimed in claim 1, wherein the controller is further configured to display information on the display, the information including a number of times the boom up pivot operation is performed with respect to the dump truck, a number of times the boom up pivot operation is autonomously performed, a weight of the to-be-loaded object loaded onto the platform of the dump truck, and a ratio of the weight of the to-be-loaded object loaded onto the platform of the dump truck to a maximum load weight of the dump truck.

17. The shovel as claimed in claim 1, wherein the controller is configured to add a preset correction value to a first position to determine a second position subsequent to the first position in said order, in setting the plurality of positions, and the preset correction value is set to a value corresponding to a size of the bucket.

* * * * *